US006426014B1

(12) United States Patent
Silverbrook

(10) Patent No.: US 6,426,014 B1
(45) Date of Patent: Jul. 30, 2002

(54) METHOD OF MANUFACTURING A THERMAL BEND ACTUATOR

(75) Inventor: Kia Silverbrook, Balmain (AU)

(73) Assignee: Silverbrook Research Pty Ltd., Balmain (AU)

( * ) Notice: Subject to any disclaimer, the term of this patent is extended or adjusted under 35 U.S.C. 154(b) by 0 days.

(21) Appl. No.: 09/524,958

(22) Filed: Mar. 14, 2000

(30) Foreign Application Priority Data

Mar. 16, 1999 (AU) ..... PP 9223

(51) Int. Cl.[7] ..... B41J 2/04
(52) U.S. Cl. ..... 216/27; 347/54
(58) Field of Search ..... 216/27; 347/20, 347/54, 61, 94; 438/21

(56) References Cited

U.S. PATENT DOCUMENTS 4,997,521 A * 3/1991 Howe et al. ..... 216/17
5,262,000 A * 11/1993 Welbourn et al. ..... 216/101
5,909,230 A * 6/1999 Choi et al. ..... 347/54
6,280,643 B1 * 8/2001 Silverbrook ..... 216/27

FOREIGN PATENT DOCUMENTS

GB 2292608 2/1996
WO WO 99/03681 1/1999

* cited by examiner

*Primary Examiner*—Anita Alanko

(57) ABSTRACT

A method of manufacture of a thermal bend actuator, the method comprising the steps of: (a) depositing and etching, using a first mask, a first material on a substrate to form a first conductive layer; (b) depositing and etching, using a second mask, a second material on the substrate to form a first sacrificial layer in a manner such that at least a portion of the first conductive layer remains uncovered; (c) depositing and etching, using a third mask, a third material on the substrate to form a first conductive bend actuator layer in a manner such that the first bend actuator layer is in electrical contact with the uncovered portion of the first conductive layer for, in use, conductive heating of the first bend actuator layer; (d) depositing and etching, using a fourth mask, a fourth material on the substrate to form a second sacrificial layer in a manner such that the second sacrificial layer covers substantially the entire first bend actuator layer; (e) depositing and etching using a fifth mask, a fifth material on the substrate to form a second bend actuator layer; and (f) etching away the first and second sacrificial layers, thereby forming a first gap between the first and the second bend actuator layers and a second gap between the first actuator layer and the top surface of the underlying substrate.

12 Claims, 30 Drawing Sheets

Mask 1

Deposit and etch 1 micron aluminum

Mask 2

Deposit and etch 1micron PECVD $Si_xN_yH_z$

Mask 3

1.5 microns sacrificial photosensitive polyimide

Mask 4

0.2 microns TiN sputtered at 300 degrees C

Mask 5

1.5 microns sacrificial photosensitive polyimide

Mask 6

0.2 microns TiN sputtered at 300 degrees C

Mask 7

8 microns sacrificial polyimide, with aluminum mask

Uses aluminum hard mask from previous step

Etch sacrificial polyimide using oxygen plasma

No Mask 1 micron conformal PECVD $Si_xN_yH_z$, 1 micron polyimide

Mask 8

Etch of Sac 4 polyimide and nozzle roof $Si_xN_yH_z$

No Mask

Deposit 0.25 microns of PECVD $Si_xN_yH_z$

No Mask 0.5 micron anisotropic 'sidewall' etch of $Si_xN_yH_z$

No Mask 4 microns softbaked resist as a protective layer

Mask 9 (includes chip edges)

Back-etch through wafer using Bosch process

No Mask

Strip all organic material using oxygen plasma

No Mask

Package, bond, prime, and test

METHOD OF MANUFACTURING A THERMAL BEND ACTUATOR

FIELD OF THE INVENTION

The present invention relates to the field of micro electromechanical devices such as ink jet printers. The present invention will be described herein with reference to Micro Electro Mechanical Inkjet technology. However, it will be appreciated that the invention does have broader applications to other micro electromechanical devices, e.g. micro electromechanical pumps or micro electromechanical movers.

BACKGROUND OF THE INVENTION

Micro electromechanical devices are becoming increasingly popular and normally involve the creation of devices on the Am (micron) scale utilizing semiconductor fabrication techniques. For a recent review on micro-mechanical devices, reference is made to the article "The Broad Sweep of Integrated Micro Systems" by S. Tom Picraux and Paul J. McWhorter published December 1998 in IEEE Spectrum at pages 24 to 33.

One form of micro electromechanical devices in popular use are ink jet printing devices in which ink is ejected from an ink ejection nozzle chamber. Many forms of ink jet devices are known.

Many different techniques on ink jet printing and associated devices have been invented. For a survey of the field, reference is made to an article by J Moore, "Non-Impact Printing: Introduction and Historical Perspective", Output Hard Copy Devices, Editors R Dubeck and S Sherr, pages 207–220 (1988).

Recently, a new form of ink jet printing has been developed by the present applicant, which is referred to as Micro Electro Mechanical Inkjet (MEMJET) technology. In one form of the MEMJET technology, ink is ejected from an ink ejection nozzle chamber utilizing an electro mechanical actuator connected to a paddle or plunger which moves towards the ejection nozzle of the chamber for ejection of drops of ink from the ejection nozzle chamber.

The present invention concerns a method of manufacture of a thermal bend actuator for use in the MEMJET technology or other micro electromechanical devices.

SUMMARY OF THE INVENTION

In accordance with a first aspect of the present invention, there is provided a method of manufacture of a thermal bend actuator, the method comprising the steps of (a) depositing and etching, using a first mask, a first material on a substrate to form a first conductive layer;

(b) depositing and etching, using a second mask, a second material on the substrate to form a first sacrificial layer in a manner such that at least a portion of the first conductive layer remains uncovered;

(c) depositing and etching, using a third mask, a third material on the substrate to form a first conductive bend actuator layer in a manner such that the first bend actuator layer is in electrical contact with the uncovered portion of the first conductive layer for, in use, conductive heating of the first bend actuator layer;

(d) depositing and etching, using a fourth mask, a fourth material on the substrate to form a second sacrificial layer in a manner such that the second sacrificial layer covers substantially the entire first bend actuator layer;

(e) depositing and etching using a fifth mask, a fifth material on the substrate to form a second bend actuator layer; and (f) etching away the first and second sacrificial layers, thereby forming a first gap between the first and the second bend actuator layers and a second gap between the first actuator layer and the top surface of the underlying substrate.

In an embodiment of the invention, in step (c) the third material may be deposited and etched to form the first bend actuator layer and a first paddle layer of the bend actuator.

In such an embodiment, in step (e) the fifth material may be deposited and etched to form the second bend actuator layer and a second paddle layer of the bend actuator.

The method may comprise, before step (b), the step of:

(g) depositing and etching, using a sixth mask, a sixth material on the substrate to form a protective layer on top of the substrate in a manner such that at least the portion of the first conductive layer remains uncovered; The method can further comprise, before step (f), the steps of (h) depositing and etching, using a seventh mask, a seventh material on the substrate to form a third sacrificial layer in a manner such that the third sacrificial layer covers substantially the entire second bend actuator layer;

(i) forming a first conformal layer of an eighth material covering the third sacrificial layer on the substrate; and wherein step (f) further comprises etching away the third sacrificial layer to form a nozzle chamber around and above the bend actuator.

The method may comprise, before step (f), the step of (j) back etching the substrate from a back surface of the substrate to the first conductive layer for facilitating step (f).

In one embodiment, the method may comprise, before step (i), the step of:

(k) depositing and etching a ninth material on the substrate to form a ninth mask in the ninth material on top of the third sacrificial layer;

(l) etching, using the tenth mask, portions of the third sacrificial layer; and wherein step (i) further comprises depositing the eighth material in a manner such as to fill the etched portions of the third sacrificial layer to form a side wall structure of the nozzle chamber.

The method can also further comprise, before step (f) the step of:

(m) etching the first conformal layer to form a nozzle of the nozzle chamber.

Step (m) may comprise depositing and etching a tenth material to form a tenth mask on top of the first conformal layer, and etching the first conformal layer through the tenth mask to from the nozzle; and wherein step (f) further comprises etching away the tenth material.

The method may further comprise, before step (f), the step of:

(n) forming a vertical nozzle wall of the nozzle by depositing and etching an eleventh material, wherein the etch comprises an overetch.

Preferably, the first conductive bend actuator layer and the second bend actuator layer can comprise substantially the same material such as titanium nitride.

There is also disclosed a device constructed in accordance with the method.

BRIEF DESCRIPTION OF THE DRAWINGS

Notwithstanding any other forms which may fall within the scope of the present invention, preferred forms of the invention will now be described, by way of example only, with reference to the accompanying drawings in which.

DESCRIPTION OF PREFERRED AND OTHER EMBODIMENTS

In the preferred embodiment, a compact form of liquid ejection device is provided which utilises a thermal bend actuator to eject ink from a nozzle chamber.

Figure 1:
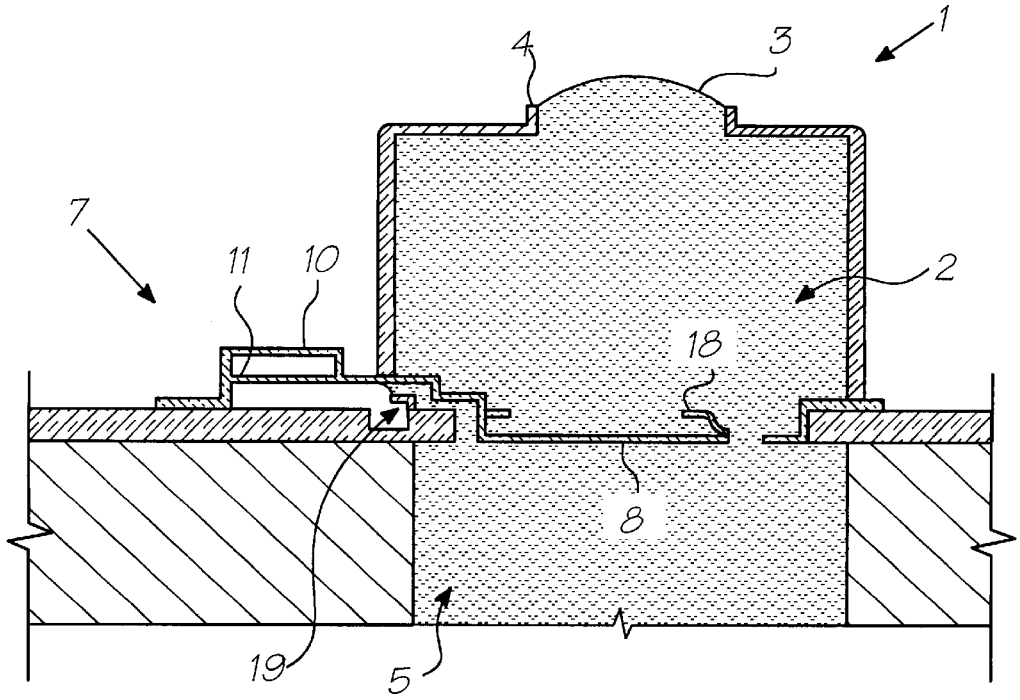
FIG. 1 to FIG. 3 illustrate schematically the operation of the preferred embodiment.
Figure 2:
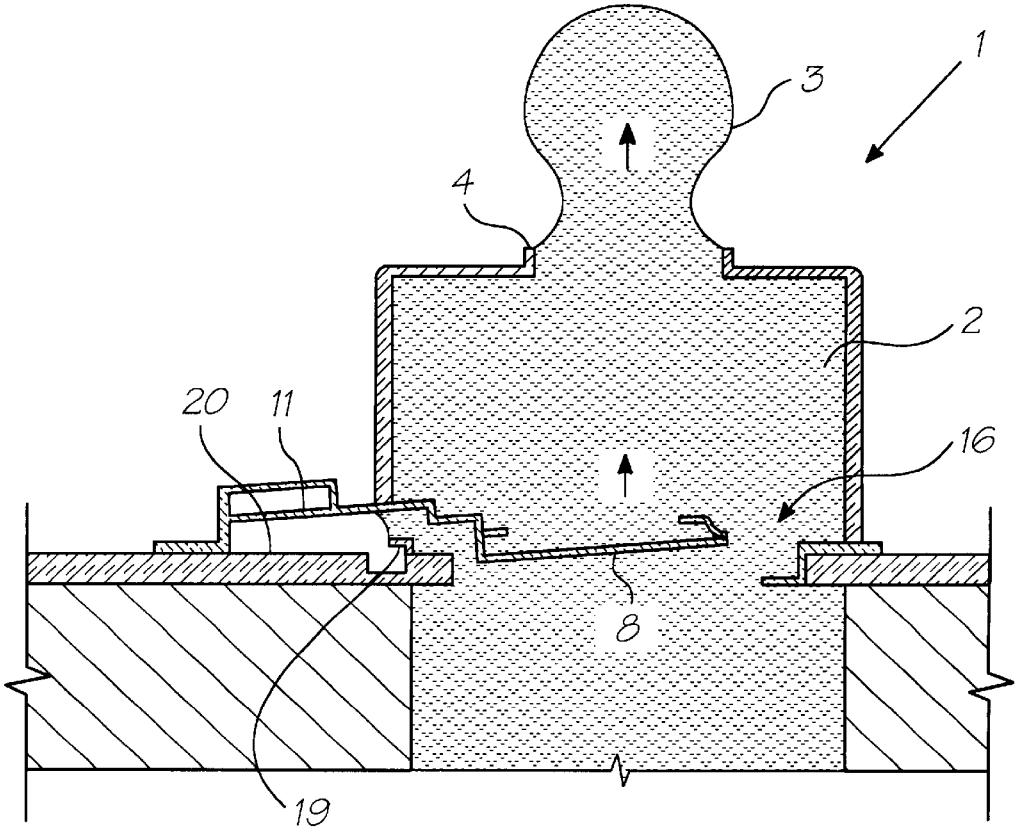
Figure 3:
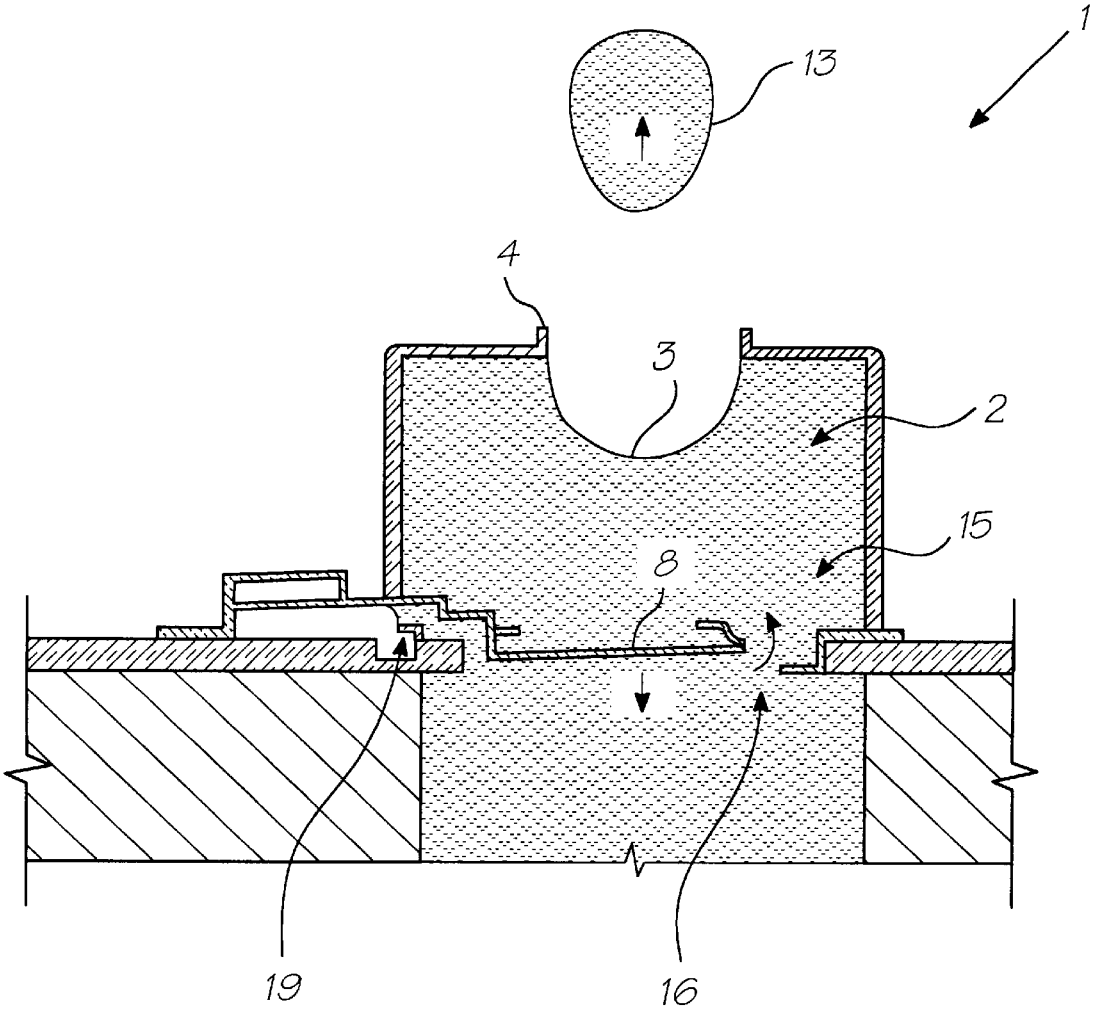

Turning initially to FIGS. 1–3 there will now be explained the operational principals of the preferred embodiment. As shown in FIG. 1, there is provided an ink ejection arrangement 1 which comprises a nozzle chamber 2 which is normally filled with ink so as to form a meniscus 3 around an ink ejection nozzle 4 having a raised rim. The ink within the nozzle chamber 2 is resupplied by means of ink supply channel 5.

The ink is ejected from a nozzle chamber 2 by means of a thermal actuator 7 which is rigidly interconnected to a nozzle paddle 8. The thermal actuator 7 comprises two arms 10, 11 with the bottom arm 11 being interconnected to a electrical current source so as to provide conductive heating of the bottom arm 11. When it is desired to eject a drop from the nozzle chamber 2, the bottom arm 11 is heated so as to cause the rapid expansion of this arm 11 relative to the top arm 10. The rapid expansion in turn causes a rapid upward movement of the paddle 8 within the nozzle chamber 2. The initial movement is illustrated in FIG. 2 with the arm 8 having moved upwards so as to cause a substantial increase in pressure within the nozzle chamber 2 which in turn causes ink to flow out of the nozzle 4 causing the meniscus 3 to bulge. Subsequently, the current to the heater 11 is turned off so as to cause the paddle 8 as shown in FIG. 3 to begin to return to its original position. This results in a substantial decrease in the pressure within the nozzle chamber 2. The forward momentum of the ink outside the nozzle rim 4 results in a necking and breaking of the meniscus so as to form meniscus 3 and a bubble 13 as illustrated in FIG. 3. The bubble 13 continues forward onto the ink print medium.

Importantly, the nozzle chamber comprises a profile edge 15, which, as the paddle 8 moves up, causes a large increase in the channel space 16 as illustrated in FIG. 2. This large channel space 16 allows for substantial amounts of ink to flow rapidly into the nozzle chamber 2 with the ink being drawn through the channel 16 by means of surface tension effects of the ink meniscus 3. The profiling of the nozzle chamber allows for the rapid refill of the nozzle chamber with the arrangement eventually returning to the quiescent position as previously illustrated in FIG. 1.

The arrangement 1 also comprises a number of other significant features. These comprise a circular rim 18, as shown in FIG. 1 which is formed around an external circumference of the paddle 8 and provides for structural support for the paddle 8 whilst substantially maximising the distance between the meniscus 3, as illustrated in FIG. 3 and the paddle surface 8. The maximising of this distance reduces the likelihood of meniscus 3 making contact with the paddle surface 8 and thereby affecting the operational characteristic. Further, as part of the manufacturing steps, an ink outflow prevention lip 19 is provided for reducing the possibility of ink wicking along a surface eg. 20 and thereby affecting the operational characteristics of the arrangement 1.

Figure 4:
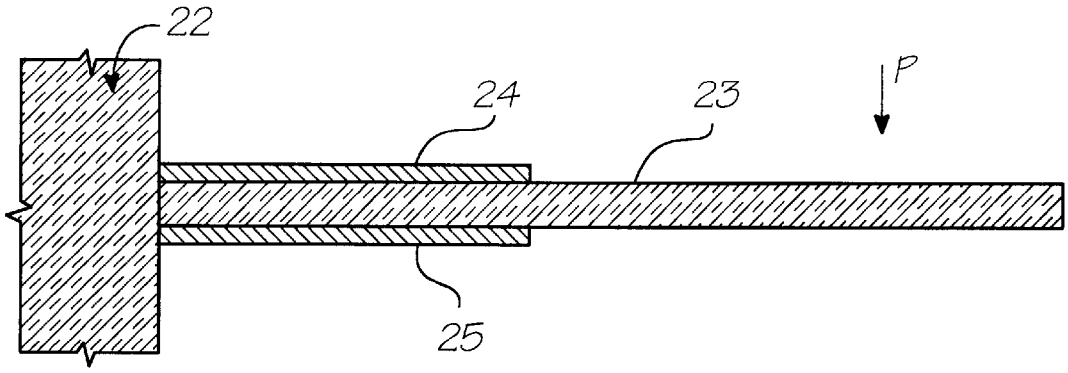
FIG. 4 to FIG. 6 illustrate schematically a first thermal bend actuator.
Figure 5:
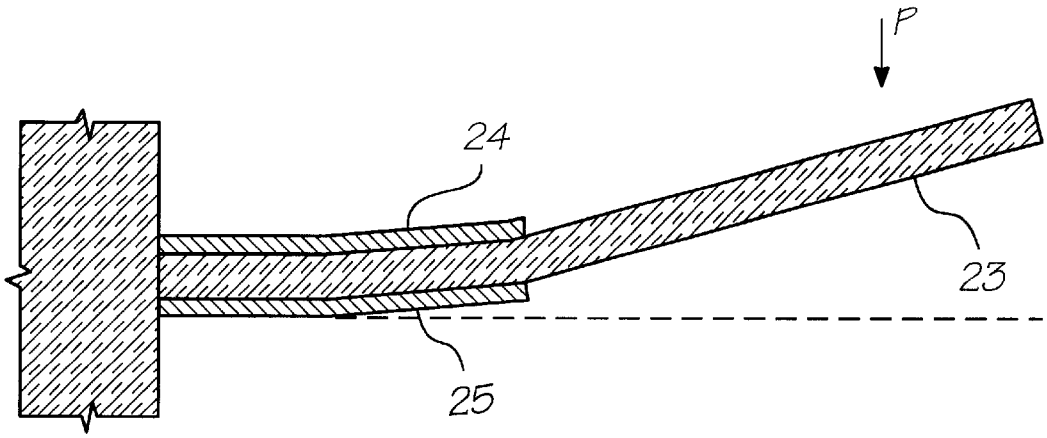

The principals of operation of the thermal actuator 7 will now be discussed initially with reference to FIGS. 4 to 10. Turning initially to FIG. 4, there is shown, a thermal bend actuator attached to a substrate 22 which comprises an actuator arm 23 on both sides of which are activating arms 24, 25. The two arms 24, 25 are preferably formed from the same material so as to be in a thermal balance with one another. Further, a pressure P is assumed to act on the surface of the actuator arm 23. When it is desired to increase the pressure, as illustrated in FIG. 5, the bottom arm 25 is heated so as to reduce the tensile stress between the top and bottom arm 24, 25. This results in an output resultant force on the actuator arm 23 which results in its general upward movement.

Figure 6:
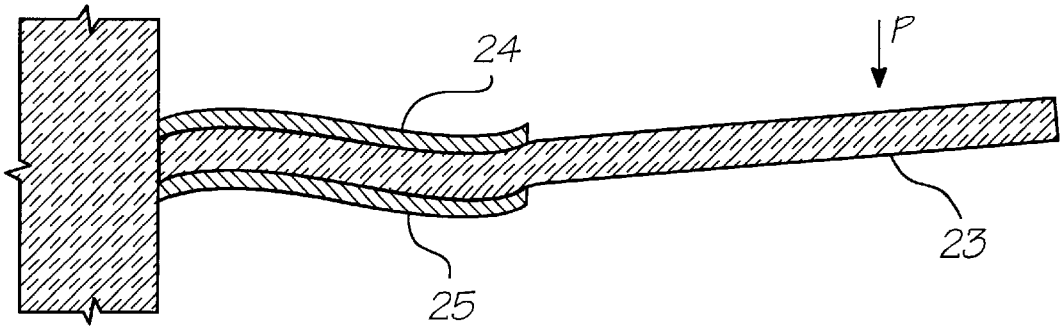
Figure 7:
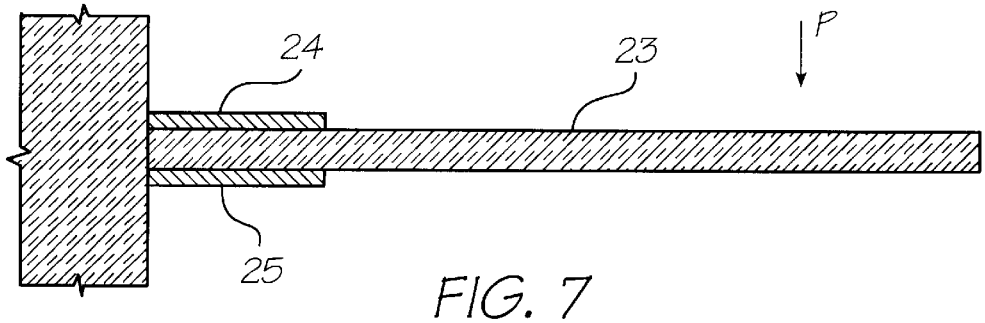
FIG. 7 to FIG. 8 illustrate schematically a second thermal bend actuator.

Unfortunately, it has been found in practice that, if the arms 24, 25 are too long, then the system is in danger of entering a buckling state as illustrated in FIG. 6 upon heating of the arm 25. This buckling state reduces the operational effectiveness of the actuator arm 23. The opportunity for the buckling state as illustrated in FIG. 6 can be substantially reduced through the utilisation of a smaller thermal bending arms 24, 25 with the modified arrangement being as illustrated in FIG. 7. It is found that, when heating the lower thermal arm 25 as illustrated in FIG. 8, the actuator arm 23 bends in a upward direction and the possibility for the system to enter the buckling state of FIG. 6 is substantially reduced.

Figure 8:
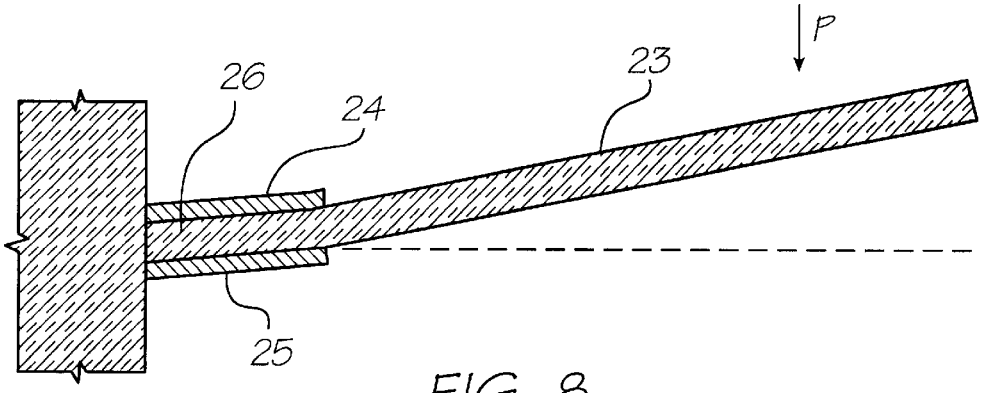

In the arrangement of FIG. 8, the portion 26 of the actuator arm 23 between the activating portion 24, 25 will be in a state of shear stress and, as a result, efficiencies of operation may be lost in this embodiment. Further, the presence of the material 26 can resulted in rapid thermal conductivity from the arm portion 25 to the arm portion 24.

Further, the thermal arm 25 must be operated at a temperature which is suitable for operating the arm 23. Hence, the operational characteristics are limited by the characteristics, eg. melting point, of the portion 26.

Figure 9:
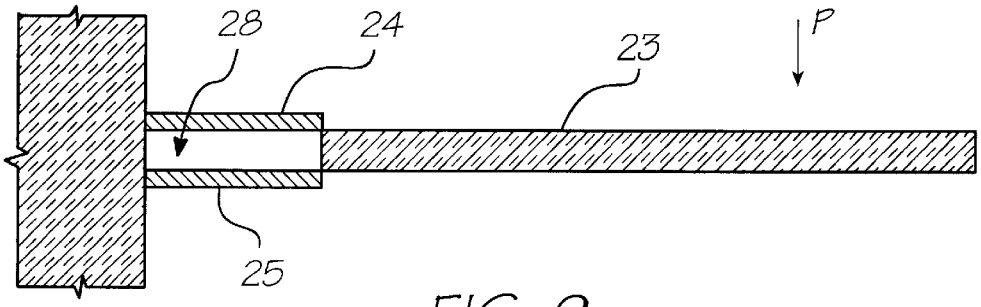
FIG. 9 to FIG. 10 illustrate schematically a third thermal bend actuator.
Figure 10:
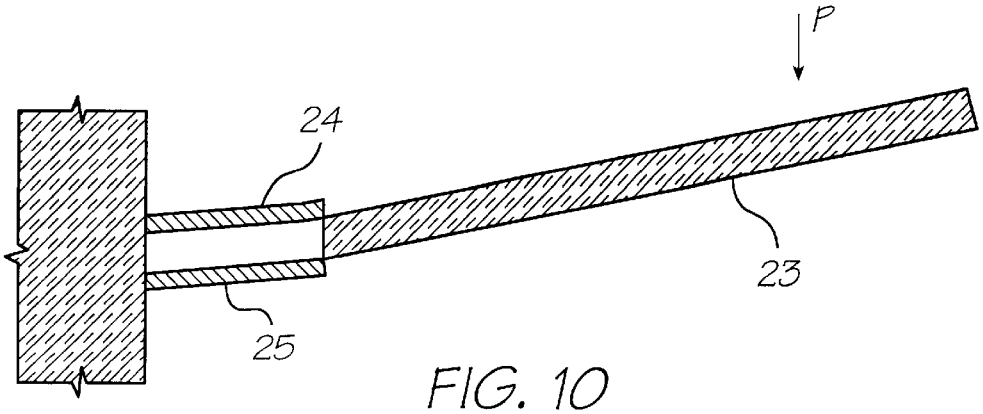

In FIG. 9, there is illustrated an alternative form of thermal bend actuator which comprises the two arms 24, 25 and actuator arm 23 but wherein there is provided a space or gap 28 between the arms. Upon heating one of the arms, as illustrated in FIG. 10, the arm 25 bends upward as before. The arrangement of FIG. 10 has the advantage that the operational characteristics eg. temperature, of the arms 24, 25 may not necessarily be limited by the material utilised in the arm 23. Further, the arrangement of FIG. 10 does not induce a sheer force in the arm 23 and also has a lower probability of delaminating during operation. These principals are utilised in the thermal bend actuator of the arrangement of FIG. 1 to FIG. 3 so as to provide for a more energy efficient form of operation.

Figure 11:
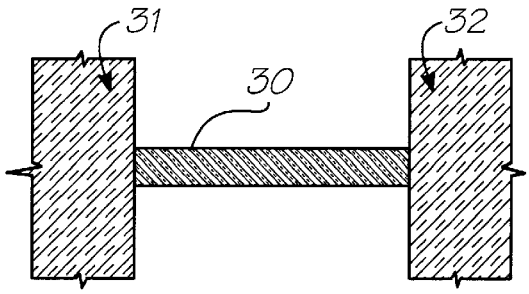
FIG. 11 illustrates schematically a further thermal bend actuator.
Figure 12:
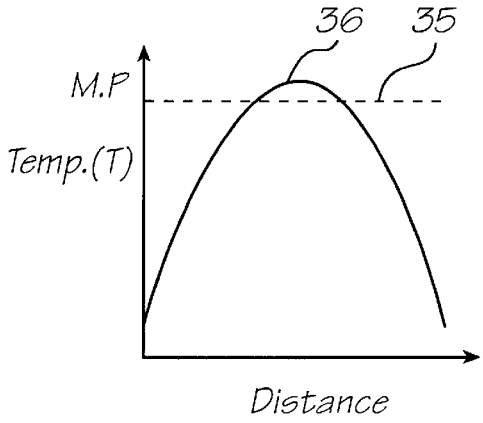
FIG. 12 illustrates an example graph of temperature with respect to distance for the arrangement of FIG. 11.

Further, in order to provide an even more efficient form of operation of the thermal actuator a number of further refinements are undertaken. A thermal actuator relies on conductive heating and, the arrangement utilised in the preferred embodiment can be schematically simplified as illustrated in FIG. 11 to a material 30 which is interconnected at a first end 31 to a substrate and at a second end 32 to a load. The arm 30 is conductively heated so as to expand and exert a force on the load 32. Upon conductive heating, the temperature profile will be approximately as illustrated in FIG. 12. The two ends 31, 32 act as "heat sinks" for the conductive thermal heating and so the temperature profile is cooler at each end and hottest in the middle. The operational characteristics of the arm 30 will be determined by the melting point 35 in that if the temperature in the middle 36 exceeds the melting point 35, the arm may fail. The graph of FIG. 12 represents a non optimal result in that the arm 30 in FIG. 11 is not heated uniformly along its length.

Figure 13:
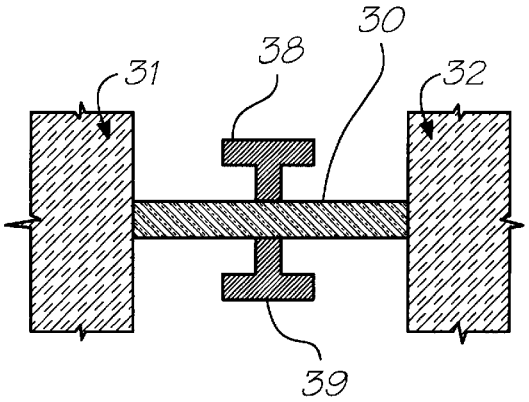
FIG. 13 illustrates schematically a further thermal bend actuator.
Figure 14:
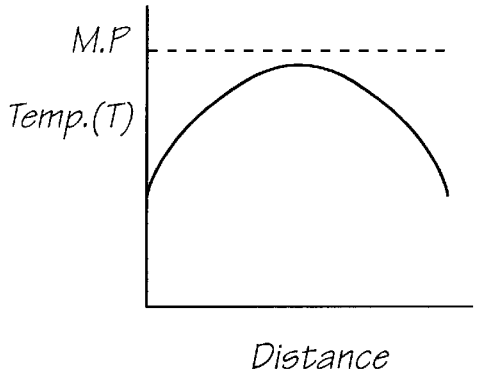
FIG. 14 illustrates an example graph of temperature with respect to distance for the arrangement of FIG. 13.

By modifying the arm 30, as illustrated in FIG. 13, through the inclusion of heat sinks 38, 39 in a central portion of the arm 30 a more optimal thermal profile, as illustrated in FIG. 14, can be achieved. The profile of FIG. 14 has a more uniform heating across the lengths of the arm 30 thereby providing for more efficient overall operation.

Figure 15:
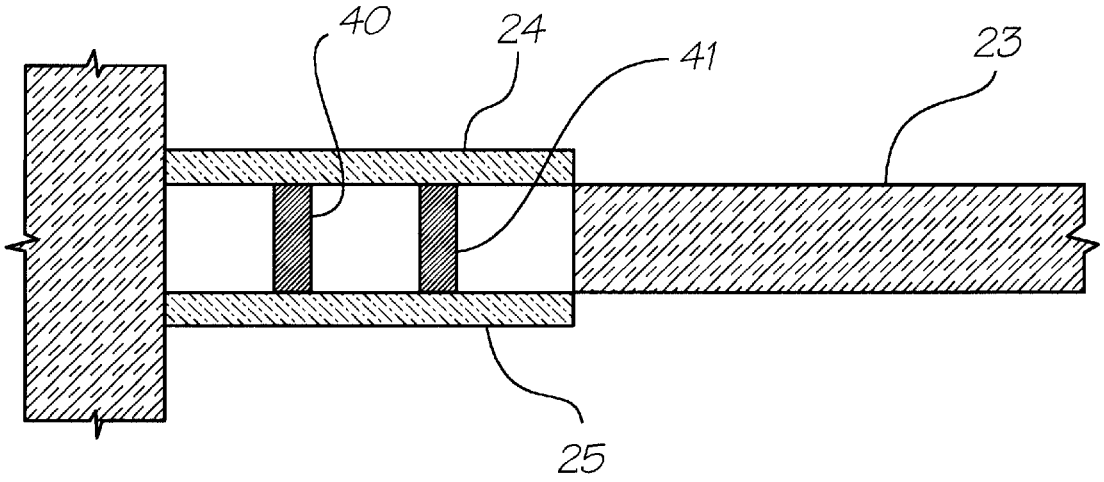
FIG. 15 illustrates schematically a further thermal bend actuator.

Turning to FIG. 15, further efficiencies and reduction in buckling likelihood can be achieved by providing a series of struts to couple the two actuator activation arms 24, 25. Such an arrangement is illustrated schematically in FIG. 15 where a series of struts, eg. 40, 41 are provided to couple the two arms 24, 25 so as to prevent buckling thereof. Hence, when the bottom arm 25 is heated, it is more likely to bend upwards causing the actuator arm 23 also to bend upwards.

The aforementioned principles are utilized in constructing an ink jet printing device constructed using MEMS fabrication techniques as described hereinafter but it will be readily evident to the person skilled in the art of microelectromechanical systems that they have other applications.

One form of detailed construction of a ink jet printing MEMS device will now be described. In the FIGS., a 1 micron grid, is utilized as a frame of reference.

MEMJET PROTOTYPE FABRICATION

Before an integrated CMOS+MEMS prototype is made, it is desirable to provide for the fabrication of a MEMS only prototype. The MEMS prototype can be made very faithfully to a full print head, with nearly identical actuator and nozzle structure. The main limitation of a MEMS only prototype is that the number of nozzles is limited, as a separate bond pad is required for each nozzle. An extension to a full CMOS arrangement is discussed later.

The prototype described here has only 15 nozzles per chip. The behavior of a few groups of 5 nozzles is a near perfect model of the entire chip performance, as the fluidic, thermal, electrical, acoustic, or mechanical coupling between 5 nozzle groups is extremely small.

Figure 72:
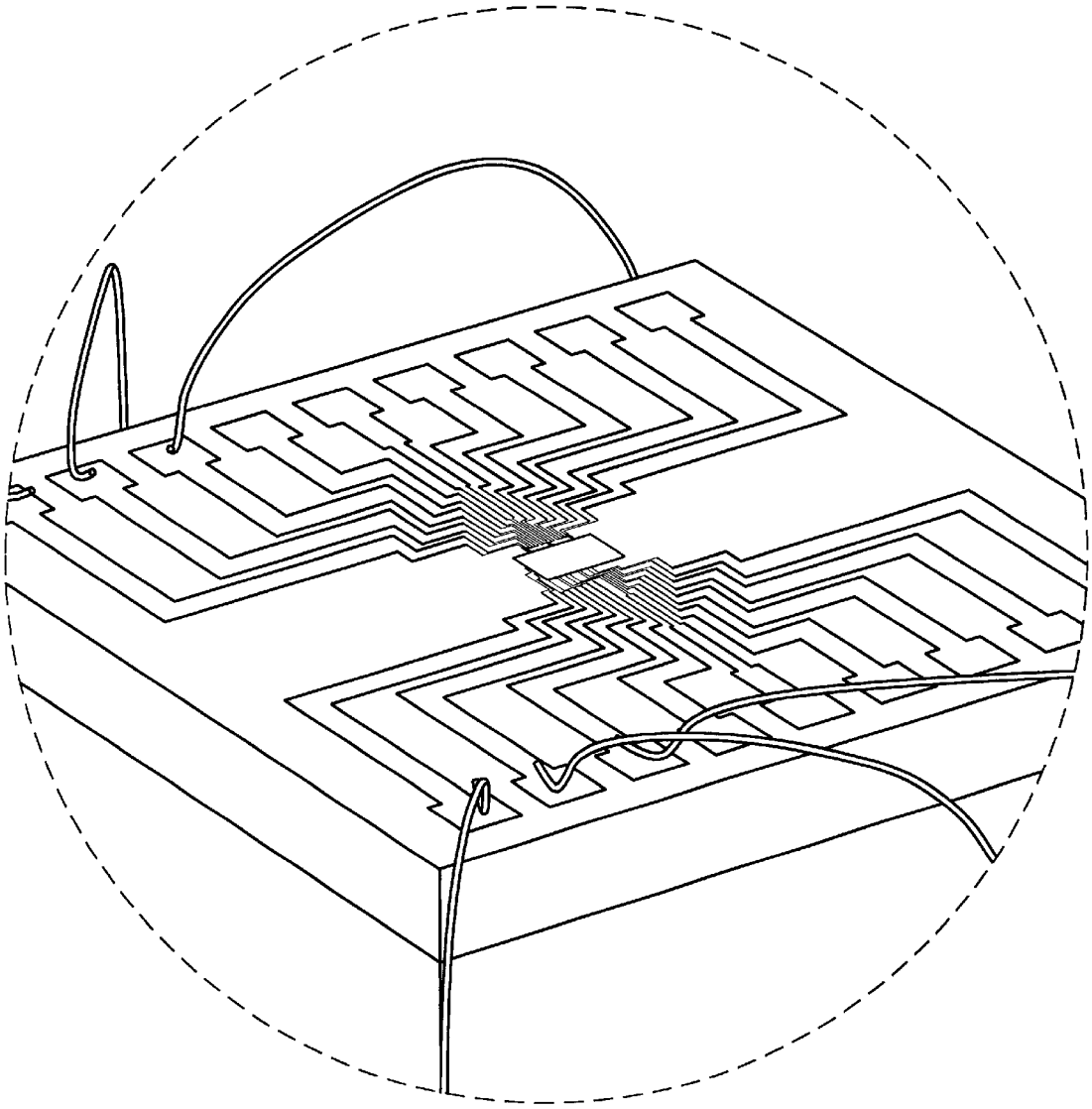
FIG. 72 illustrates a side perspective view of a prototype chip.

A chip layout with 15 nozzles is shown in FIG. 72. This chip is 3 mm×3 mm, and is replicated on a 1.2×1.2 cm mask set. The chip can be manufactured using the following process steps with the drawings illustrating the masks etc for a single nozzle unit cell.

1) 1 Micron Aluminum

Figure 16:
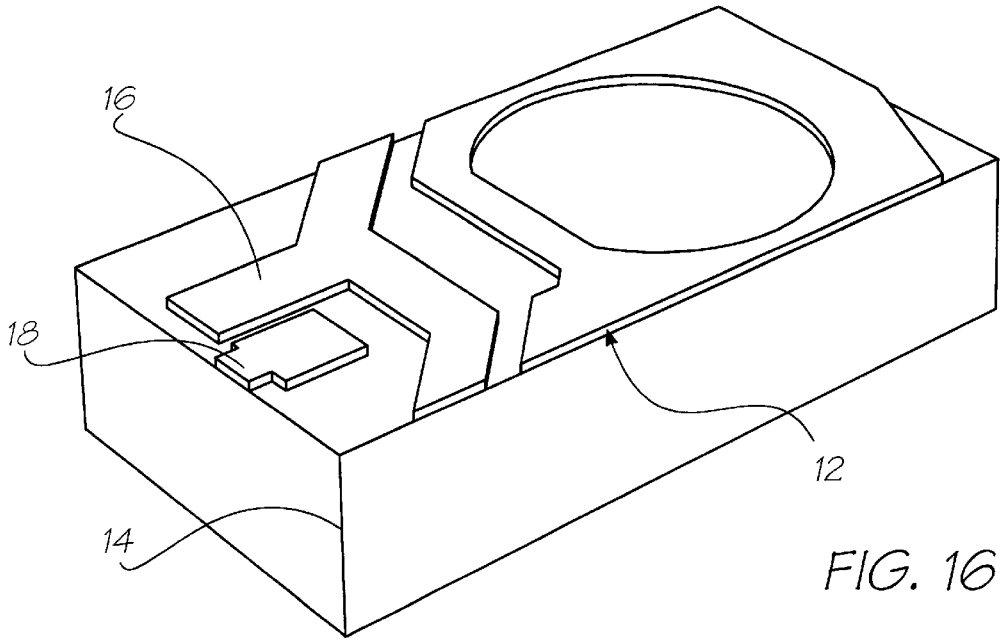
FIG. 16 illustrates a side perspective view of the aluminum layer.
Figure 17:
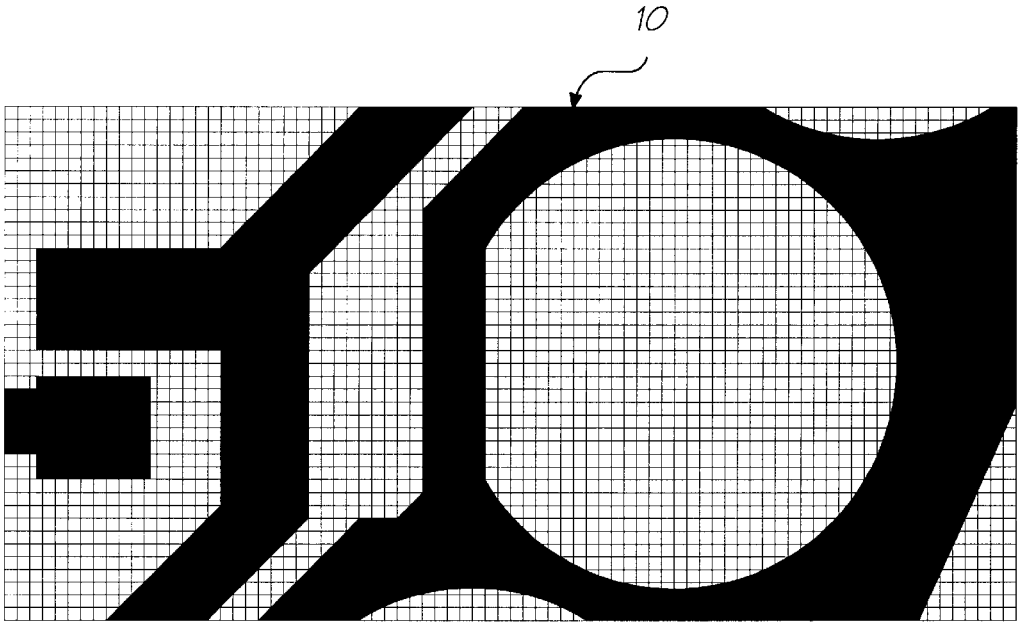
FIG. 17 illustrates a plan view of the aluminum mask.
Figure 18:
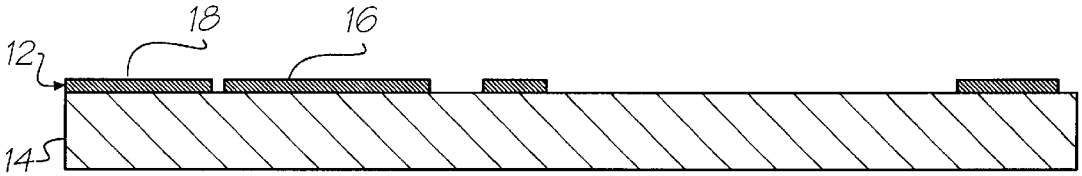
FIG. 18 illustrates a side sectional view of the aluminum layer.

One micron of aluminum 12 is deposited and etched on a substrate 14 using Mask 10 (FIG. 17) leaving the structure as illustrated in FIGS. 16 and 18. This mask 10 includes the electrodes 16 to the actuator, the bond pads 18, and the wiring between these items. It is possible to replace the aluminum with TiN wiring and bond pads. However, that would diverge further from the CMOS+MEMS design, and add process risks. The region around the nozzle chamber is on Metal 1 for a 1P2M CMOS+MEMS process, while the electrodes are on metal 2.

2) 1 Micron PECVD Nitride

Figure 19:
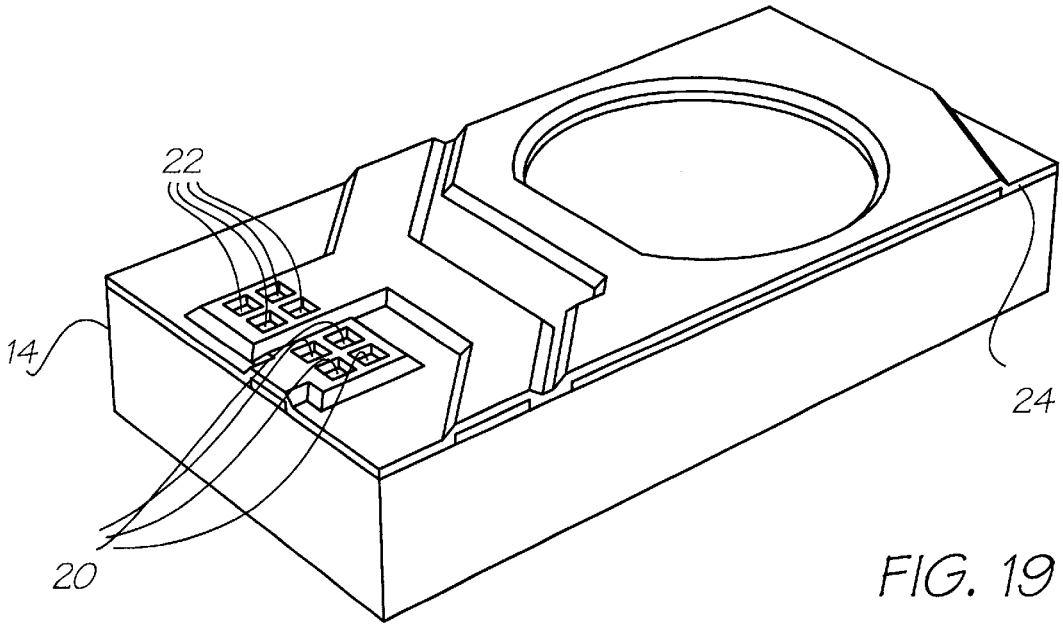
FIG. 19 illustrates a side perspective view of the first silicon Nitride layer.
Figure 20:
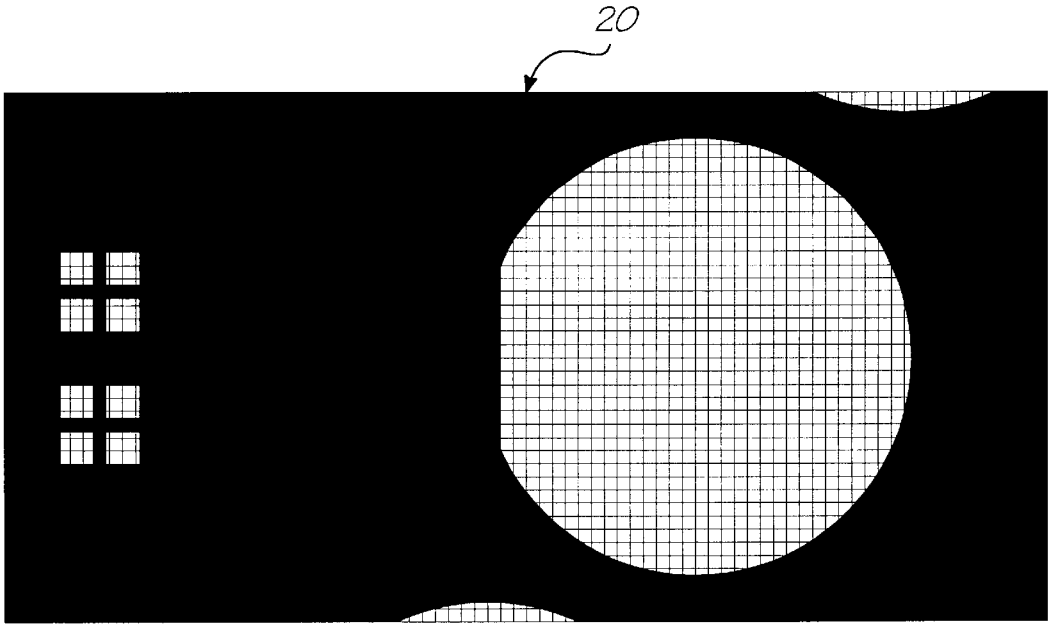
FIG. 20 illustrates a plan view of the first silicon Nitride mask.
Figure 21:
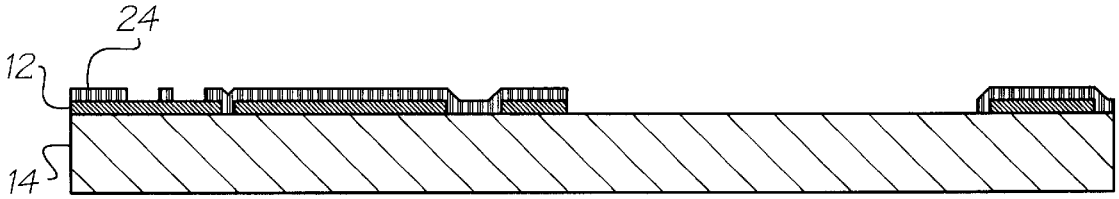
FIG. 21 illustrates a side sectional view of the first silicon Nitride layer.

One micron of PECVD silicon nitride 24 is deposited and etched using Mask 20 (FIG. 20) so as to leave the structure illustrated in FIGS. 19 and 21. This mask 20 includes the vias 22 from the aluminum to the first TiN layer, and some fluid control aspects. For a CMOS+MEMS process, this is the passivation layer, and will typically be 0.5 microns of glass followed by 0.5 microns of silicon nitride. A pure nitride passivation layer is preferable, to prevent ions from the ink from diffusing through the glass.

Figure 22:
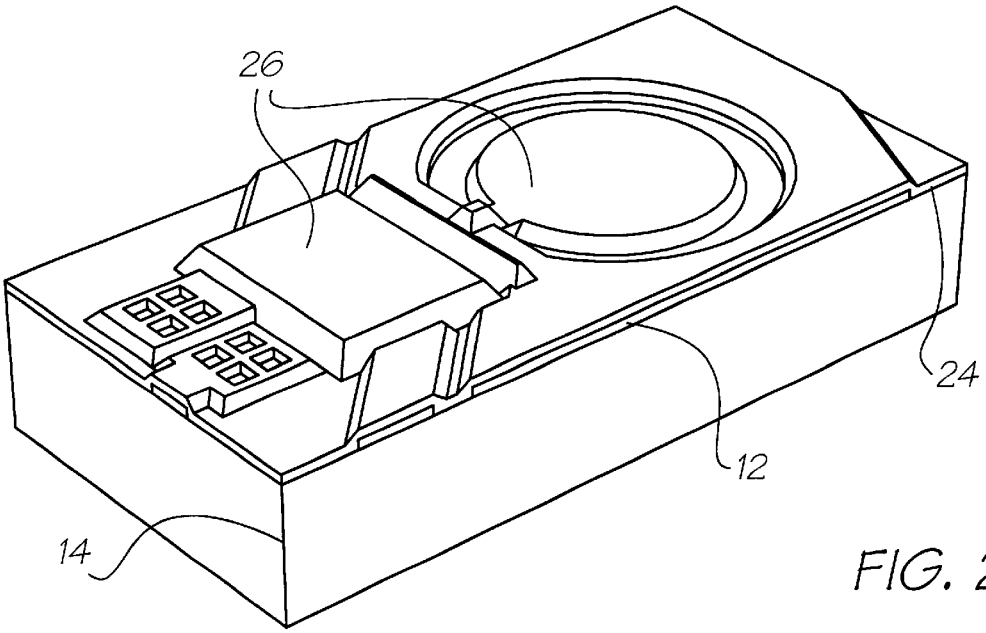
FIG. 22 illustrates a side perspective view of the first sacrificial polyimide layer.
Figure 23:
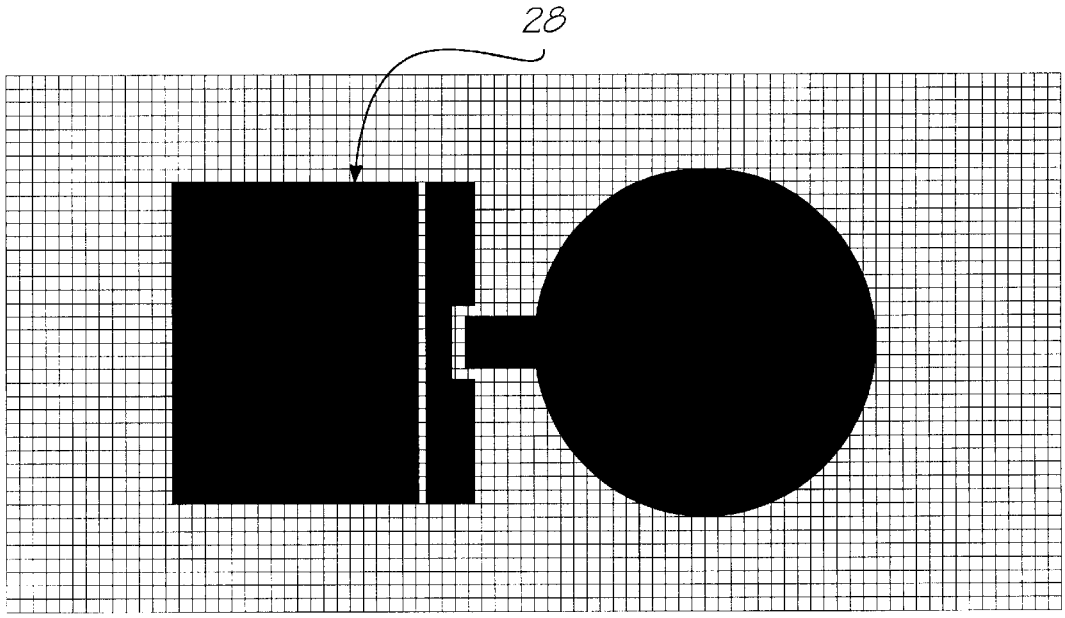
FIG. 23 illustrates a plan view of the first sacrificial polyimide mask.
Figure 24:
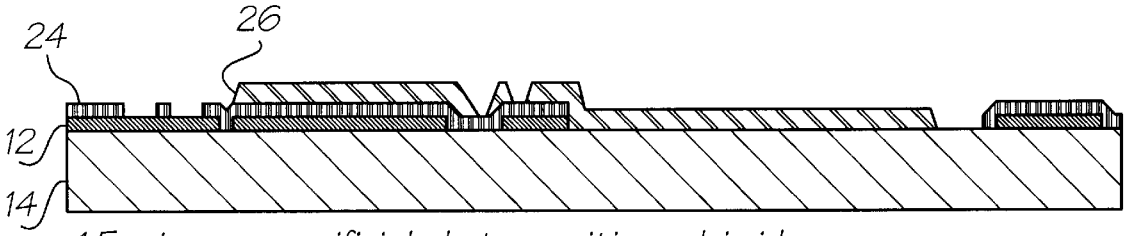
FIG. 24 illustrates a side sectional view of the first sacrificial polyiride layer.

3) 1.5 Microns Sacrificial Polyimide 1.5 microns of spin-on photosensitive polyimide 26 is deposited and exposed using UV light to Mask 28 (FIG. 23) so as to leave the structure illustrated in FIGS. 22 and 24. The polyimide 26 is then developed. The polyimide 26 is sacrificial, so there is a wide range of alternative materials which can be used. Photosensitive polyimide simplifies the processing, as it eliminates deposition, etching, and resist stripping steps.

Figure 25:
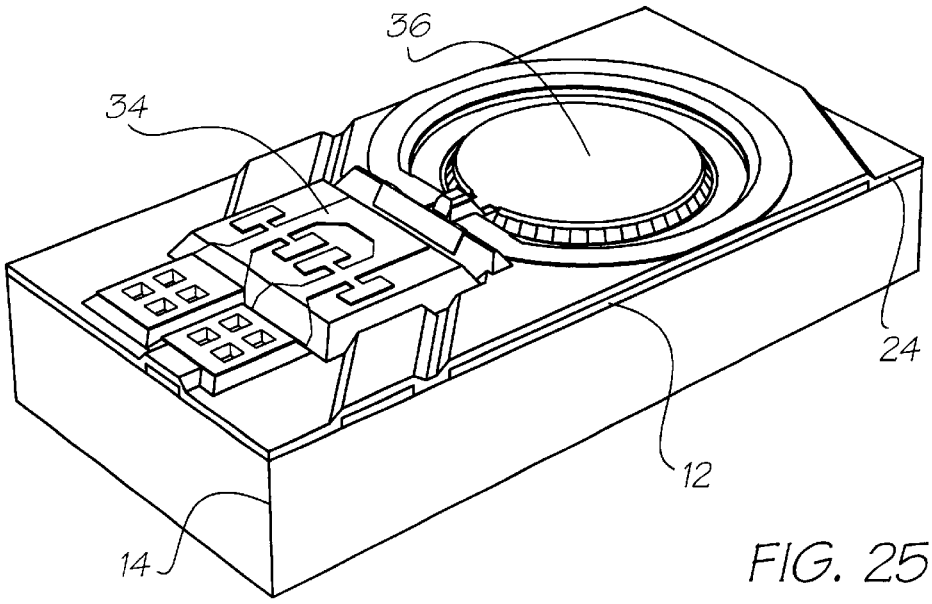
FIG. 25 illustrates a side perspective view of the first Titanium Nitride layer.
Figure 26:
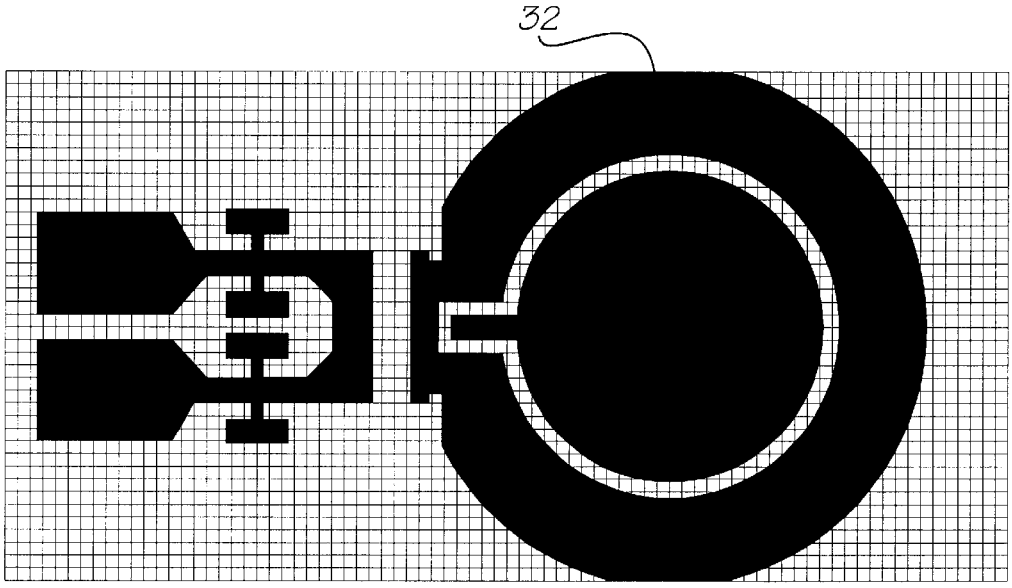
FIG. 26 illustrates a plan view of the first Titanium Nitride mask.
Figure 27:
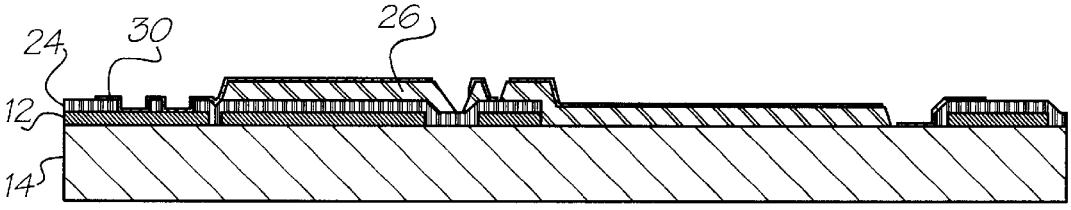
FIG. 27 illustrates a side sectional view of the first Titanium Nitride layer.

4) 0.2 Microns TiN 0.2 microns of magnetron sputtered titanium nitride 30 is deposited at 300° C. and etched using Mask 32 (FIG. 26) so as to leave the structure illustrated in FIGS. 25 and 27. This layer 30 contains the actuator layer 34 and part of the paddle 36. In production, the resistivity of this layer of TiN should be consistent to within a few percent over the wafer.

Figure 28:
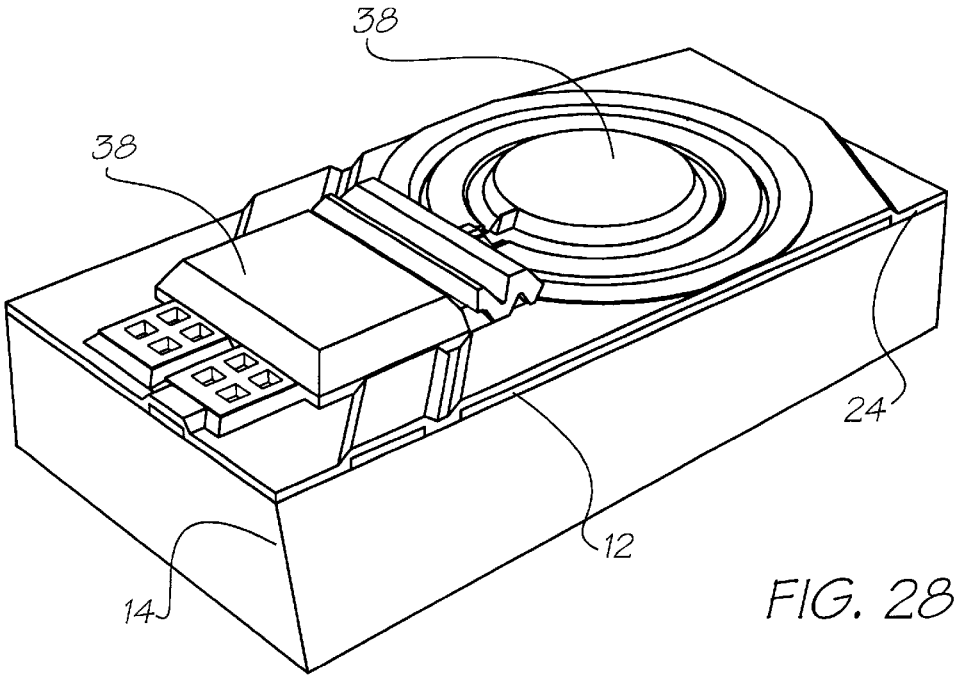
FIG. 28 illustrates a side perspective view of the second sacrificial polyimide layer.
Figure 29:
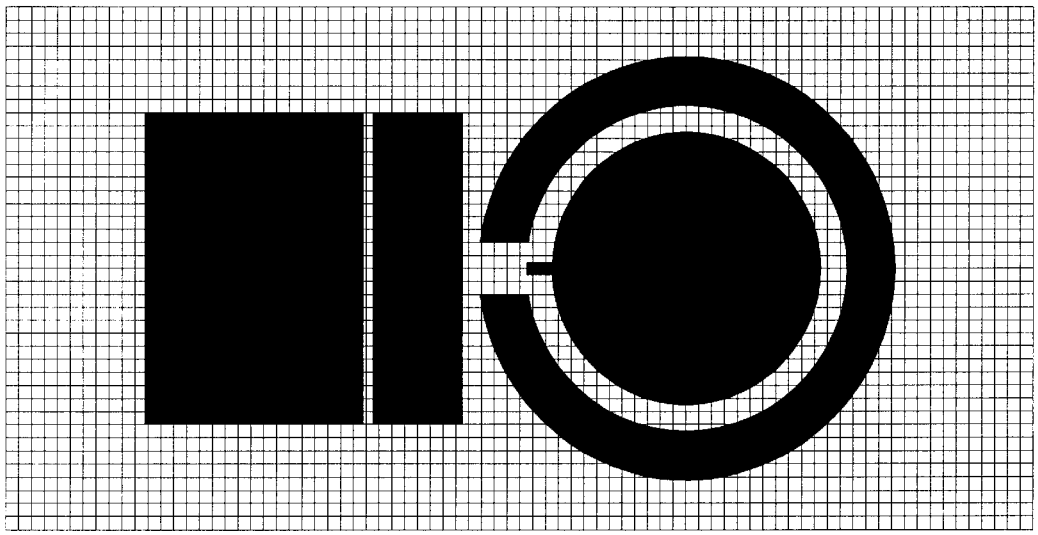
FIG. 29 illustrates a plan view of the second sacrificial polyimide mask.
Figure 30:
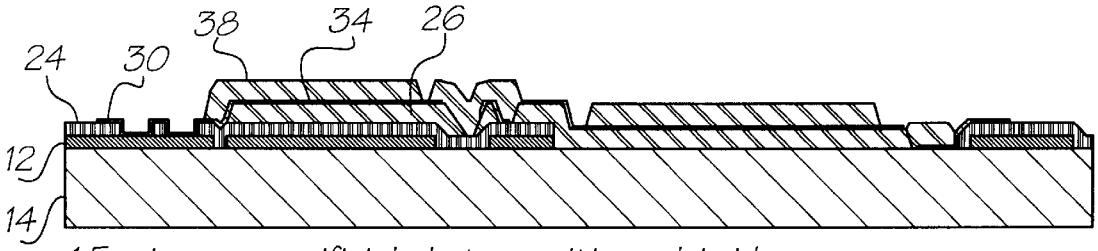
FIG. 30 illustrates a side sectional view of the second sacrificial polyimide layer.

5) 1.5 Microns Sacrificial Polyimide 1.5 microns of photosensitive polyimide 38 is spun on and exposed using UV light to Mask 40 (FIG. 29) so as to leave the structure illustrated in FIGS. 28 and 30. The polyimide 38 is then developed. The thickness determines the gap between the actuator layer 34 and compensator TiN layers (step 6), so has an effect on the amount that the actuator layer 34 bends. As with step 3, the use of photosensitive polyimide simplifies the processing over other sacrificial materials.

6) 0.2 Microns Sputtered TiN

Figure 31:
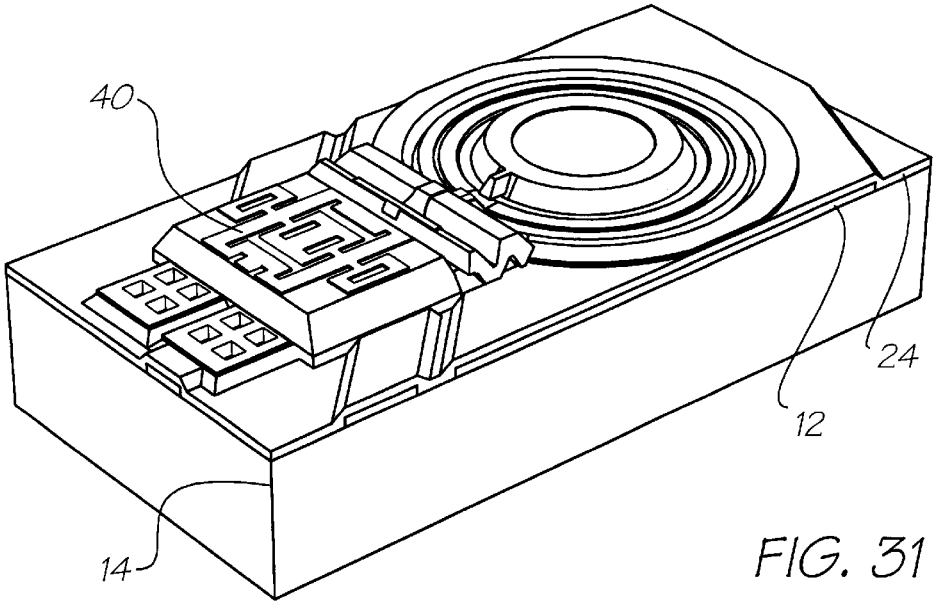
FIG. 31 illustrates a side perspective view of the second Titanium Nitride layer.
Figure 32:
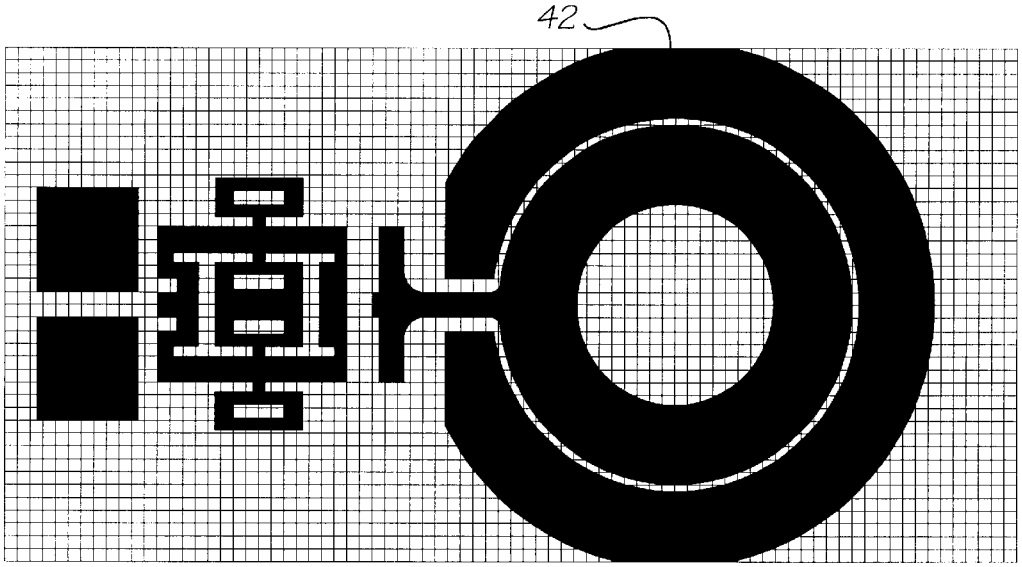
FIG. 32 illustrates a plan view of the second Titanium Nitride mask.
Figure 33:
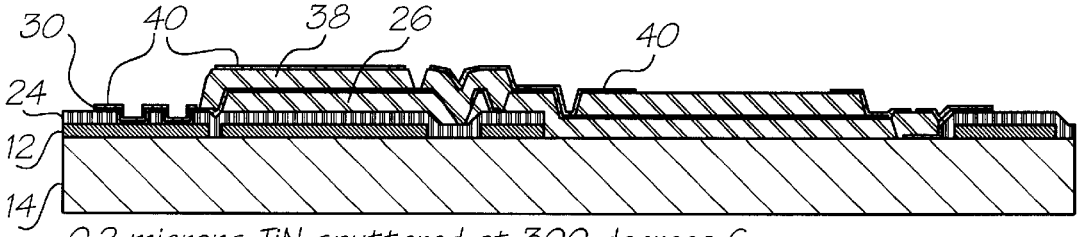
FIG. 33 illustrates a side sectional view of the second Titanium Nitride layer.

Deposit 0.2 microns of magnetron sputtered titanium nitride 40, at 300° C. The TiN is etched using Mask 42 (FIG. 32) so as to leave the structure as illustrated in FIG. 31 and 33. The electrical properties of the TiN 40 are not important. This top layer of TiN 40 is not electrically connected, and is used purely as a mechanical component.

Figure 34:
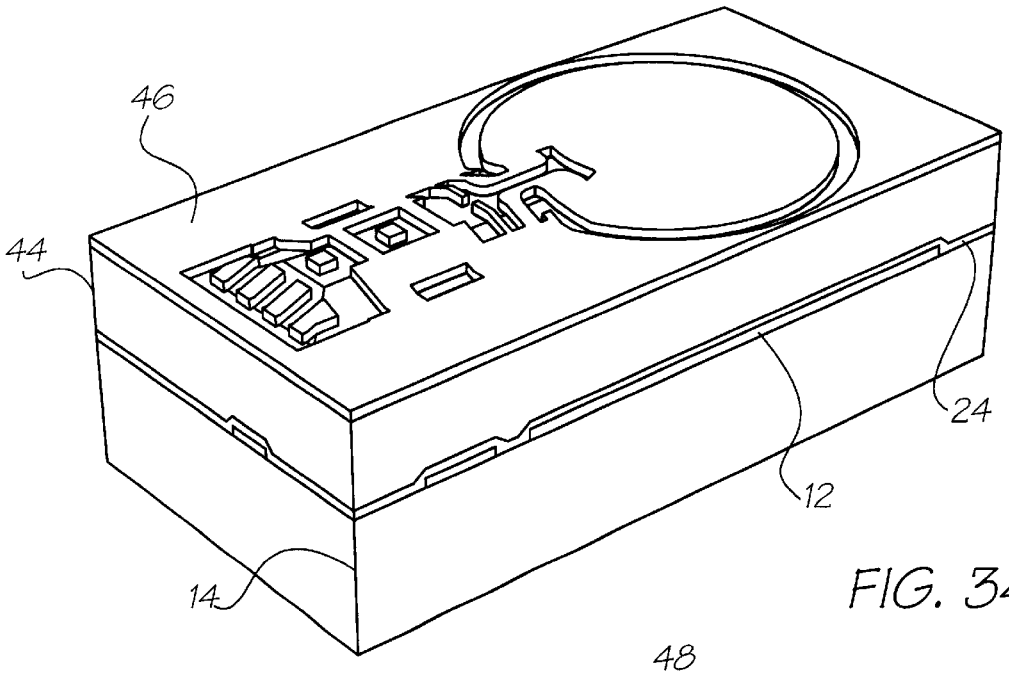
FIG. 34 illustrates a side perspective view of the third sacrificial polyimide layer.
Figure 35:
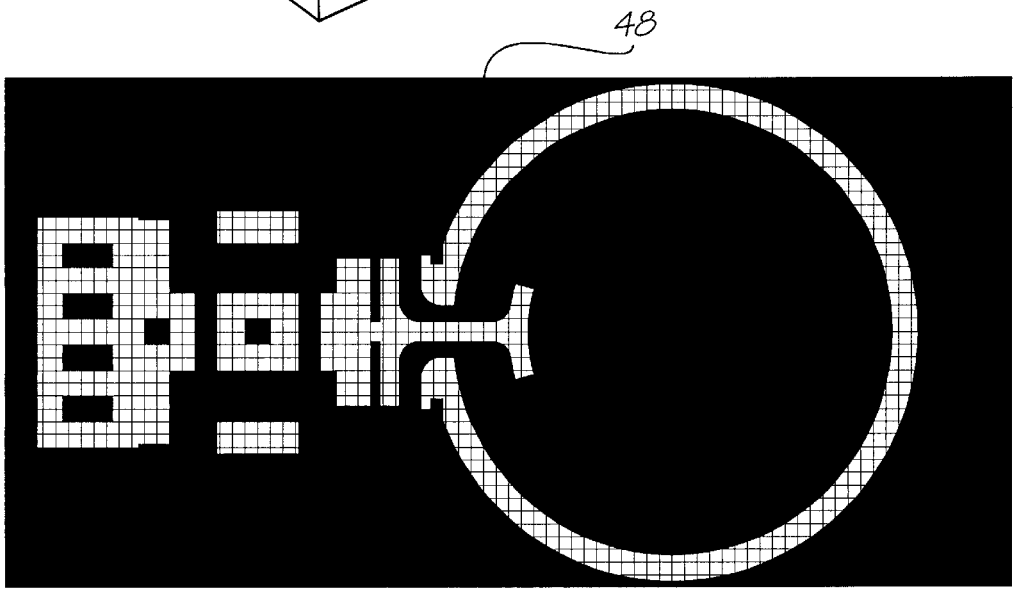
FIG. 35 illustrates a plan view of the third sacrificial polyimide mask.
Figure 36:
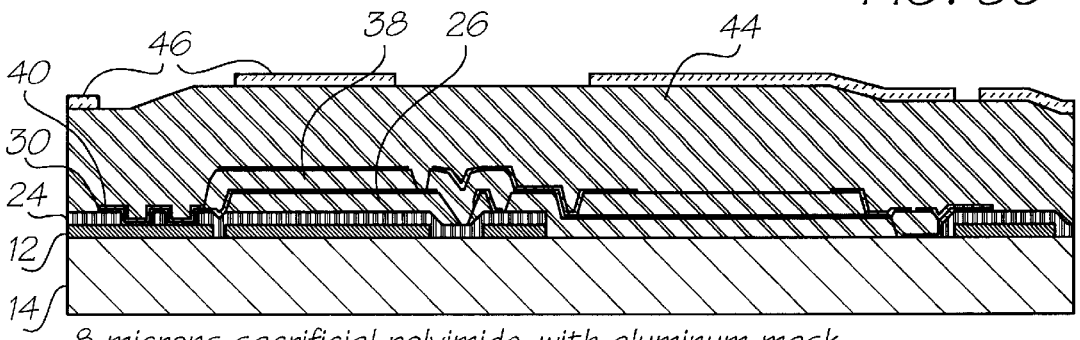
FIG. 36 illustrates a side sectional view of the third sacrificial polyimide layer.
Figure 37:
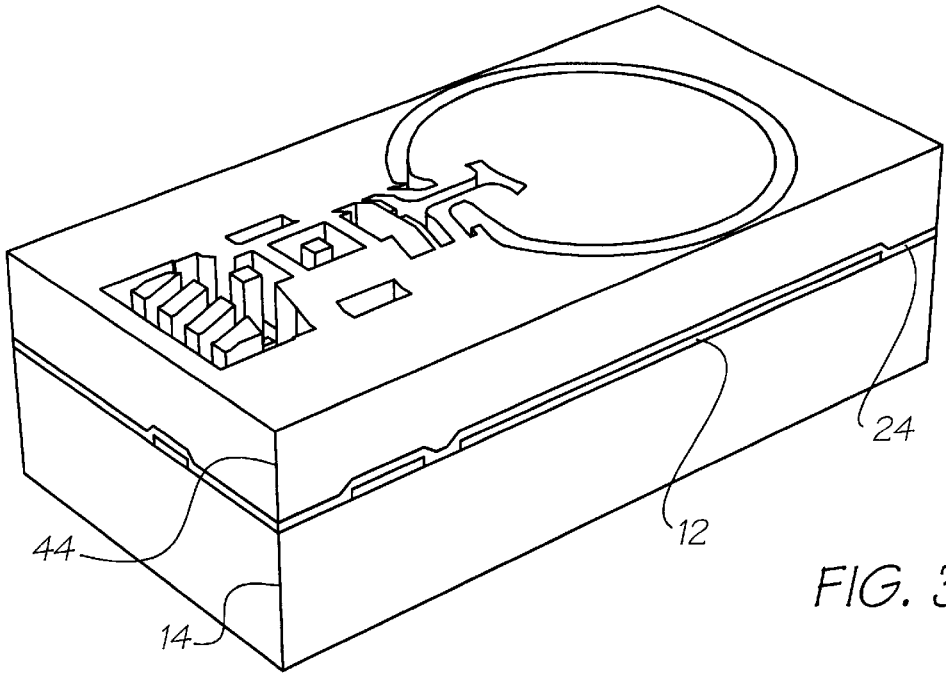
FIG. 37 illustrates a side perspective view of the sacrificial polyimide etch.
Figure 38:
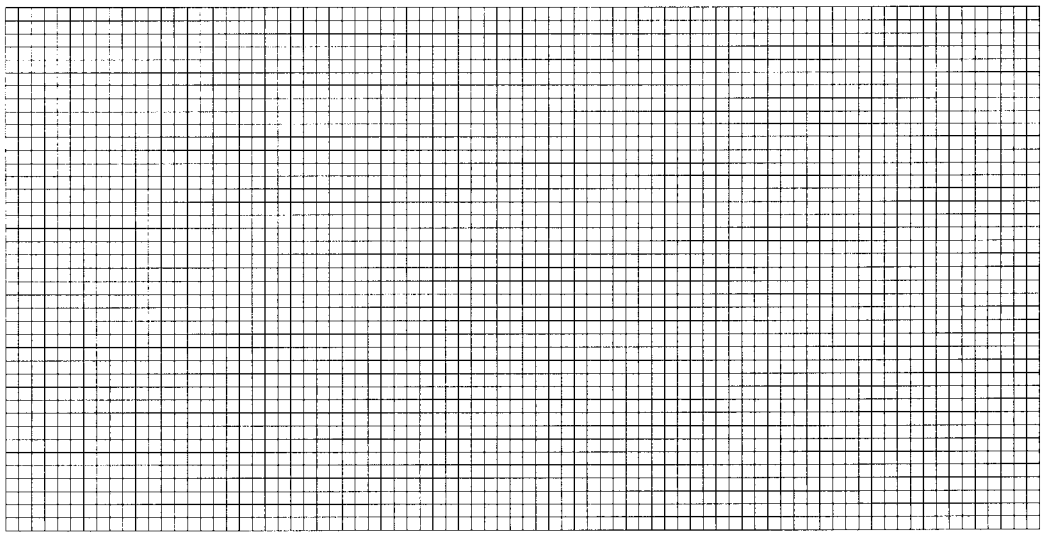
FIG. 38 illustrates a plan view of no mask.
Figure 39:
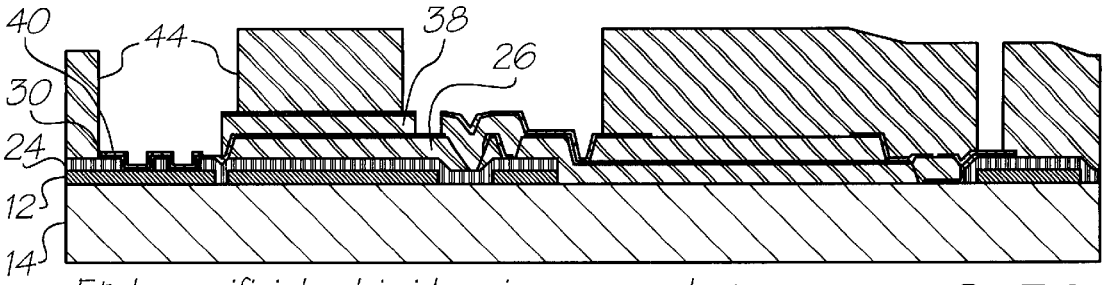
FIG. 39 illustrates a side sectional view of the sacrificial polyimide etch.

7) 8 Microns Sacrificial Polyimide, Al mask 8 microns of standard polyimide 44 is spun on and hardbaked This thickness ultimately determines the height to the nozzle chamber roof. As long as this height is above a certain distance (determined by drop break-off characteristics), then the actual height is of little significance. As this polyimide layer 44 is not photosensitive, it may be a filled layer to obtain a lower coefficient of thermal expansion. A 50 nm aluminum hard mask (not shown) is deposited. One micron of resist 46 is spun on and exposed to Mask 48 (FIG. 35) resulting in the structure illustrated in FIGS. 34 and 36. Subsequently, the 50 nm aluminum hard mask (not shown) is etched utilizing the resist layer 46 as a mask. This etch may be a wet etch or a dry etch. Finally, an anisotropic oxygen plasma etch is then conducted to remove the resist 46 and portions of polyimide layer 44 using the 50 nm aluminum hard mask, resulting in the structure illustrated in FIGS. 37 and 39.

8) Deposit PECVD silicon nitride

Figure 40:
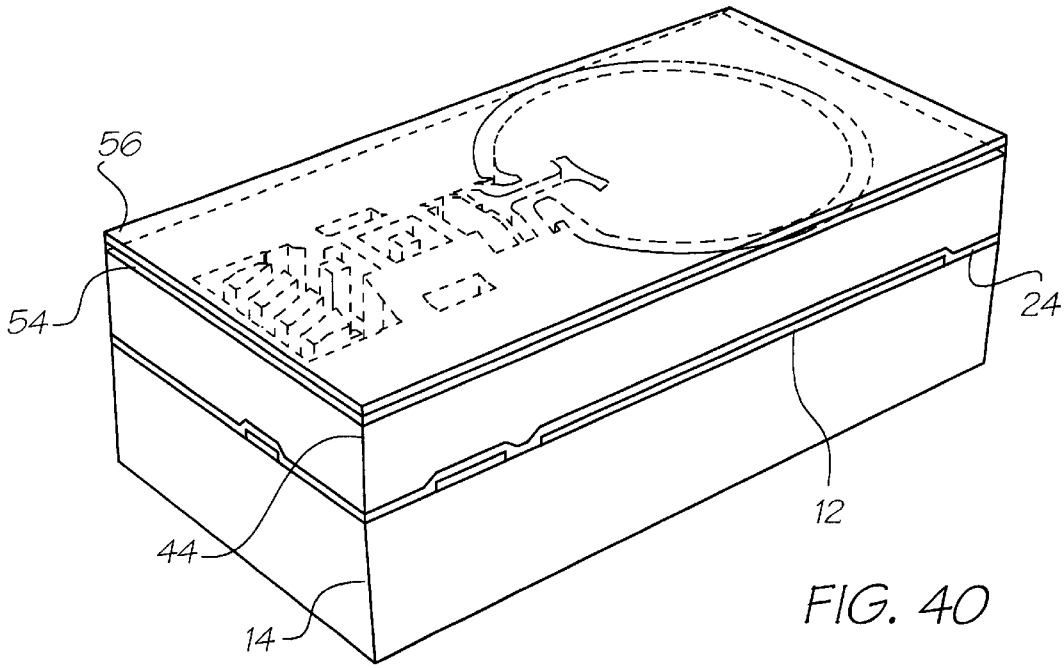
FIG. 40 illustrates a side perspective view of the conformal silicon nitride deposition.
Figure 41:
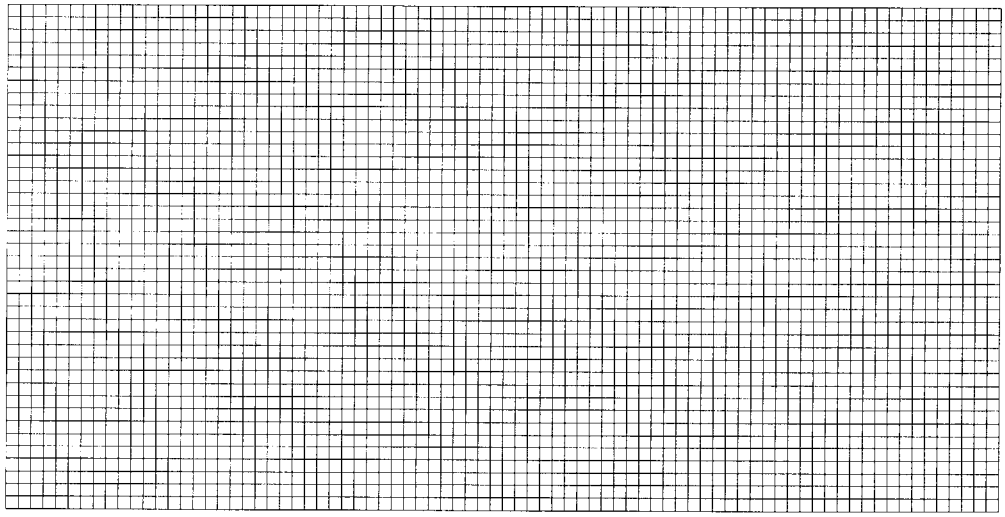
FIG. 41 illustrates a plan view of no mask.
Figure 42:
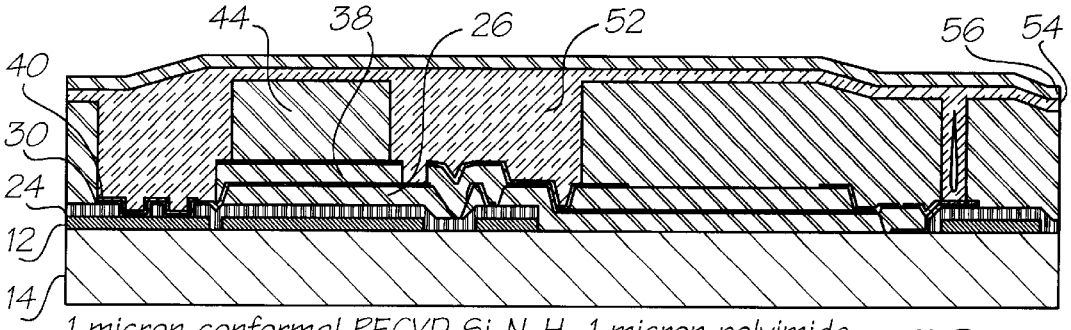
FIG. 42 illustrates a side sectional view of the conformal silicon nitride deposition.

PECVD silicon nitride 53 is deposited at 300° C., filling the channels formed in the previous polyimide layer 44, forming the nozzle chamber 50. 1 micron of PECVD silicon nitride 54 is deposited at 300° C. (no mask—FIG. 41). This layer is not particularly critical. The major requirement is good adhesion to TiN. Enclosed vacuoles should not cause problems. The nitride deposition is followed by 1 micron of polyimide 56, which is hardbaked. The resulting structure is as illustrated in FIGS. 40 and 42.

9) Etch Polyimide and Nitride

Figure 43:
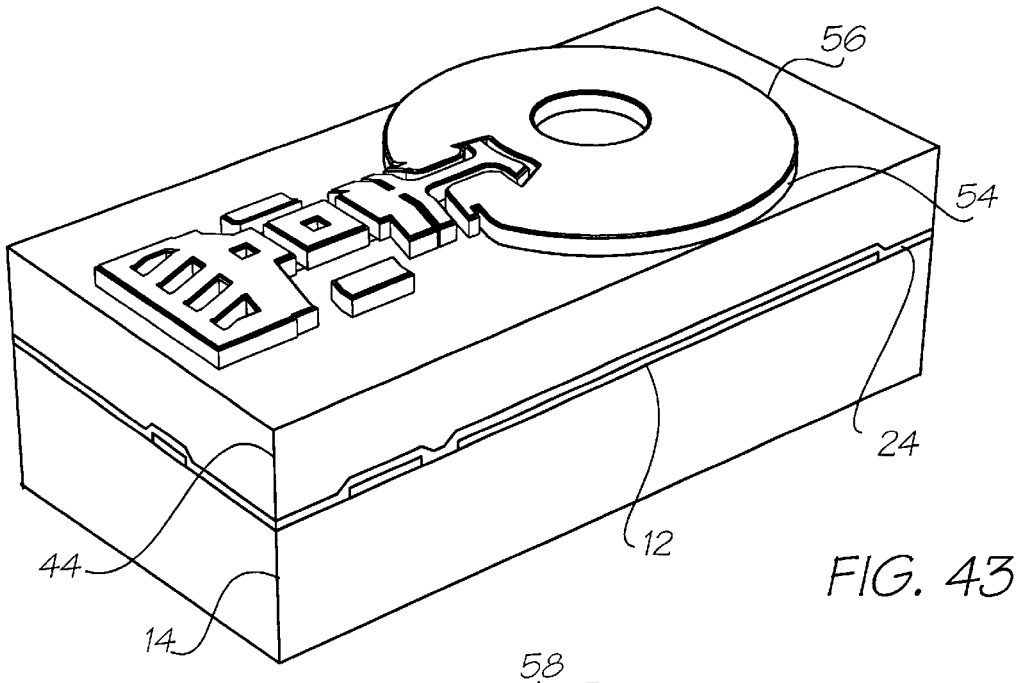
FIG. 43 illustrates a side perspective view of the sacrificial polyimide etch.
Figure 44:
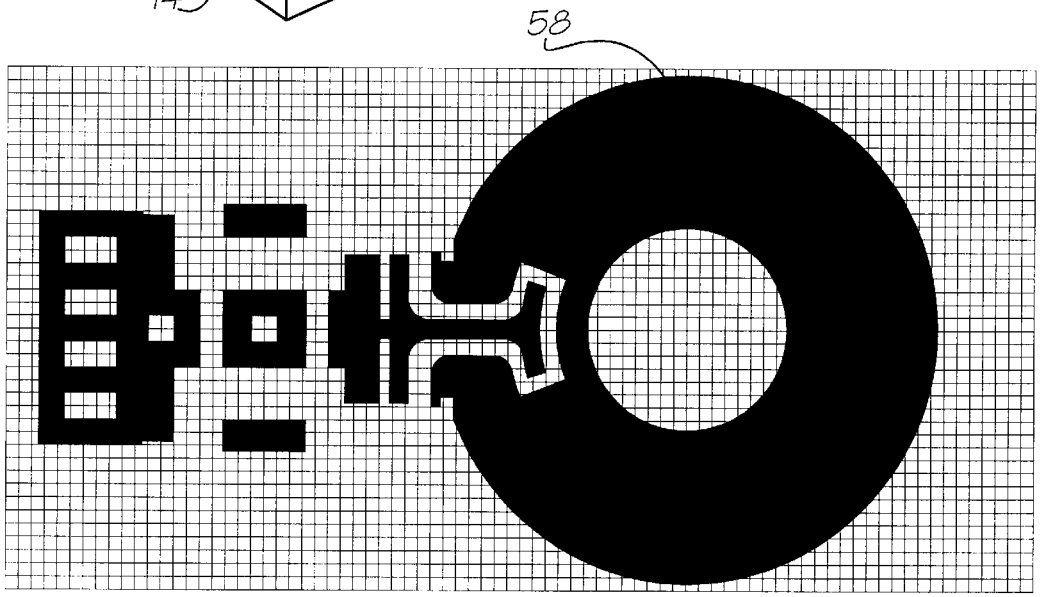
FIG. 44 illustrates a plan view of the polyimide etch mask.
Figure 45:
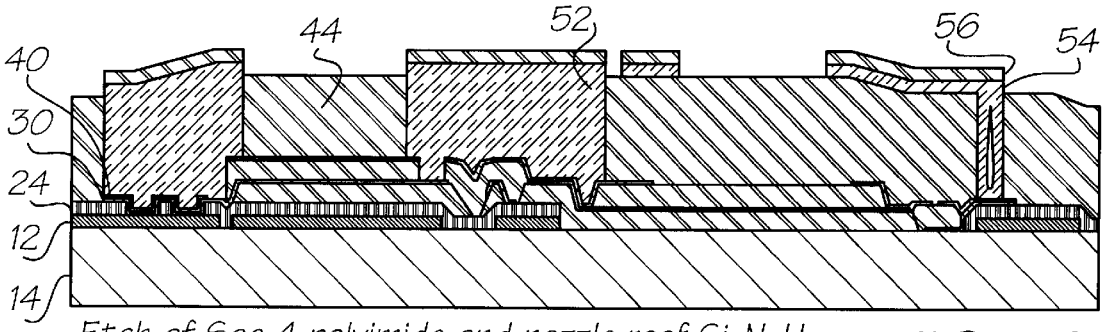
FIG. 45 illustrates a side sectional view of the sacrificial polyimide etch.

The polyimide 56 is etched down to nitride 54 using Mask 58 as shown in FIG. 44. The nitride 54 is then etched down to polyimide 44 using the polyimide 56 as a mask leaving the resulting structure as shown in FIG. 43 to FIG. 45.

Figure 46:
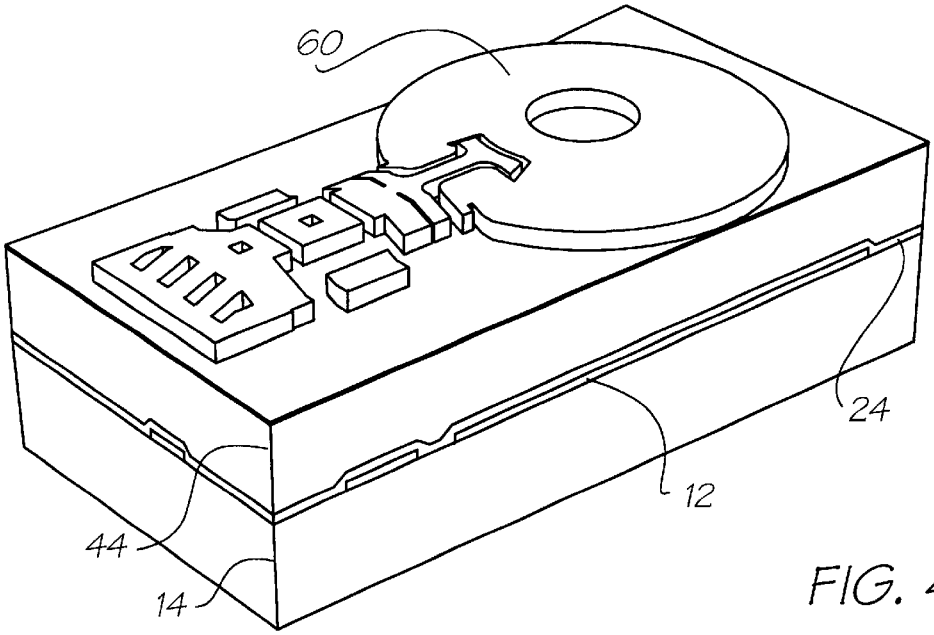
FIG. 46 illustrates a side perspective view of the PECVD nitride deposition.
Figure 47:
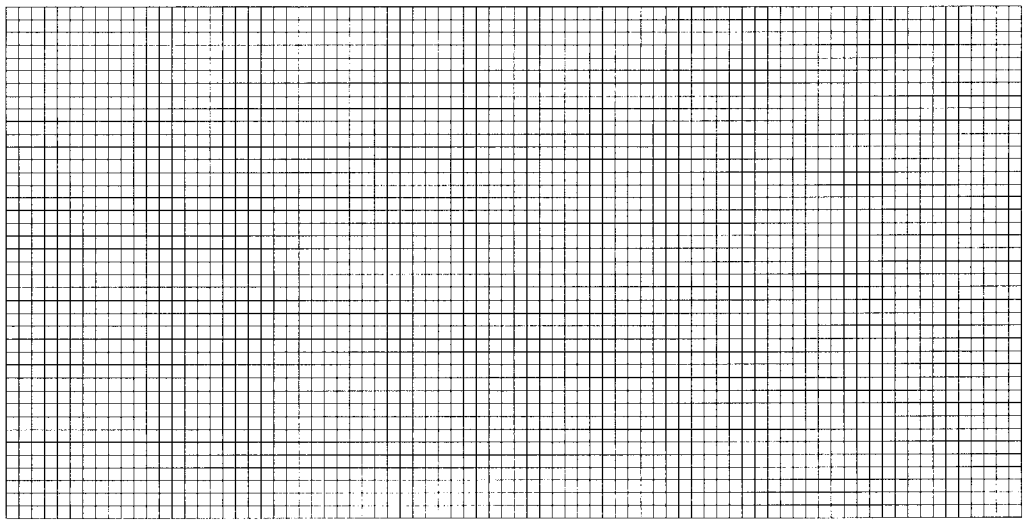
FIG. 47 illustrates a plan view of no mask.
Figure 48:
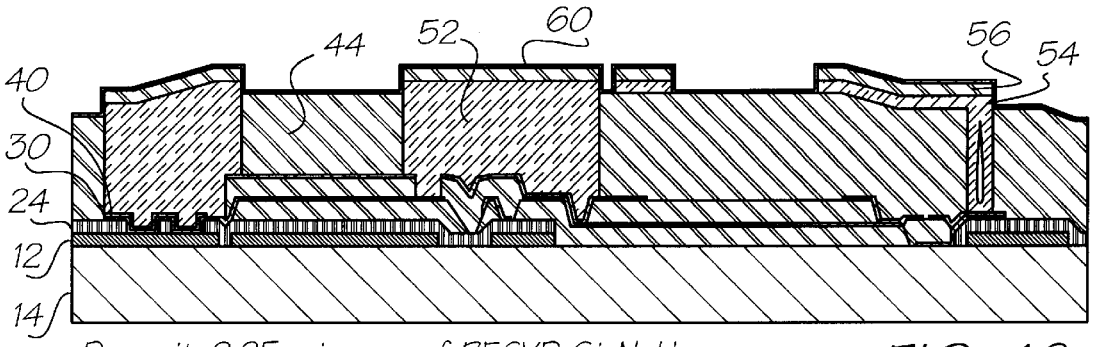
FIG. 48 illustrates a side sectional view of the PECVD nitride deposition.

10) Deposit 0.25 Microns of PECVD Nitride 0.25 microns of conformal PECVD silicon nitride 60 is deposited at 300° C. using no mask (FIG. 47). This layer ultimately forms the nozzle rims, using a "sidewall spacer" like process. The thickness is not particularly critical, and could be substantially thinner if desired, as there is insignificant fluidic pressure acting on the rim. The resulting structure is as illustrated in FIGS. 46 and 48.

11) Anisotropic Etch of Nitride

Figure 49:
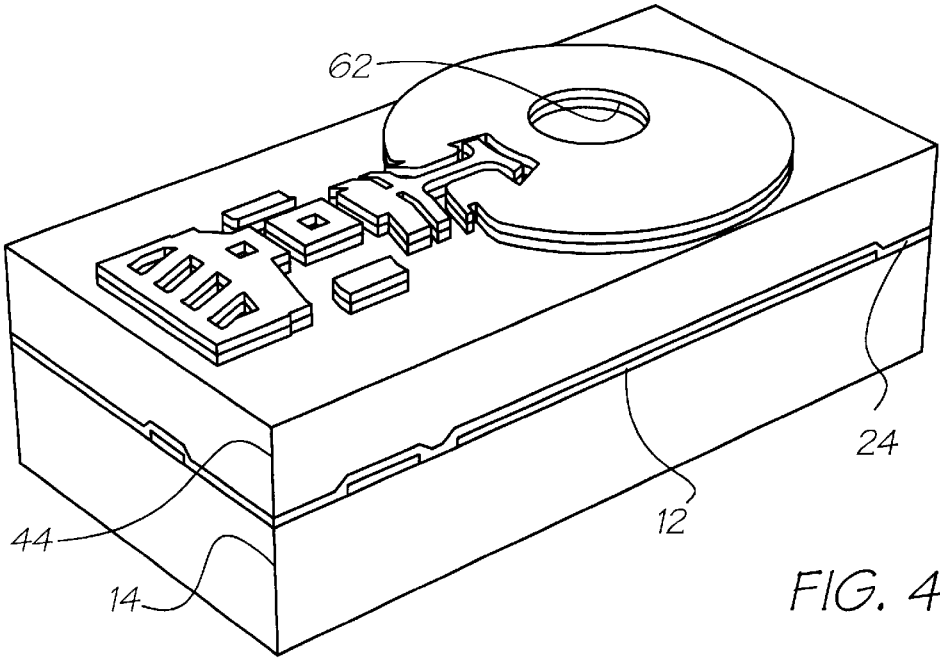
FIG. 49 illustrates a side perspective view of the Anisotropic Nitride etch.
Figure 50:
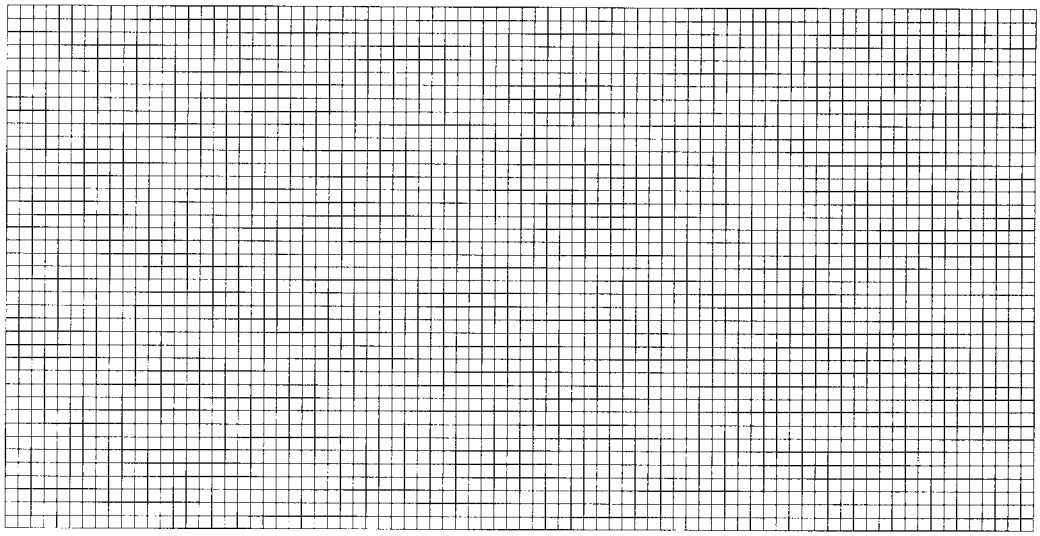
FIG. 50 illustrates a plan view of no mask.
Figure 51:
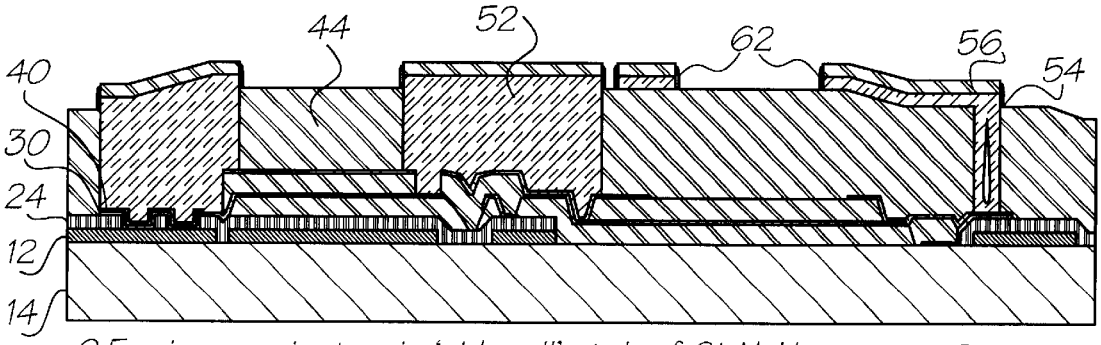
FIG. 51 illustrates a side sectional view of the Anisotropic Nitride etch.

The nozzle rim nitride 60 is anisotropically plasma etched with out a mask (FIG. 50). The etch can be timed, as etch depth is not critical. Substantial overetch is required to ensure than only vertical nitride walls 62 remain, and that nitride over sloping topography is completely removed. The resulting structure is as illustrated in FIGS. 49 and 51.

12) 4 Microns of Softbaked Resist

Figure 52:
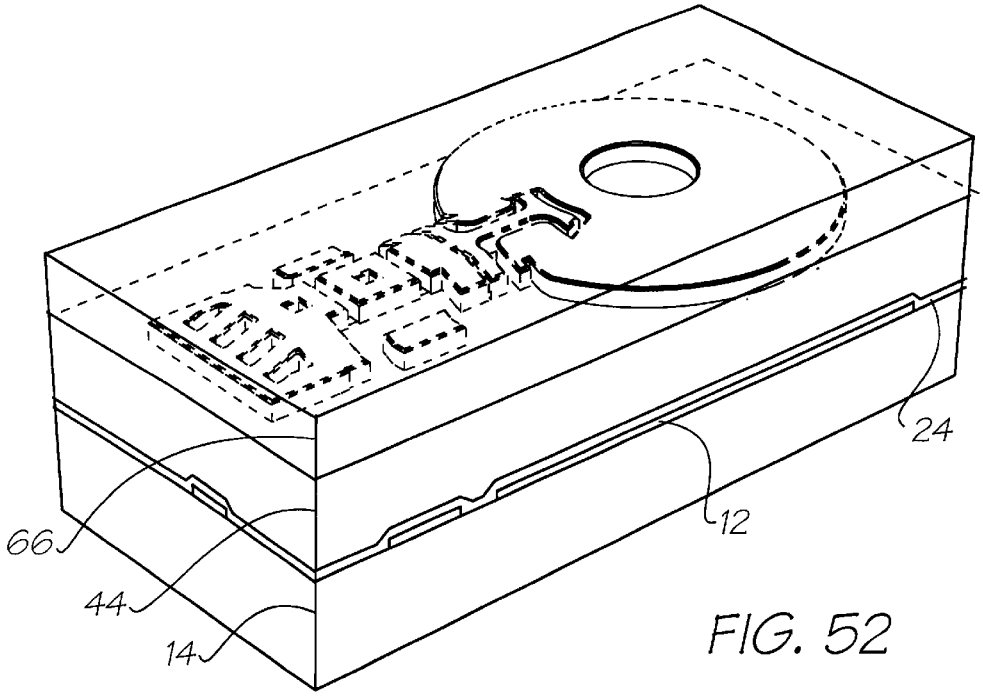
FIG. 52 illustrates a side perspective view of the softbake resist.
Figure 53:
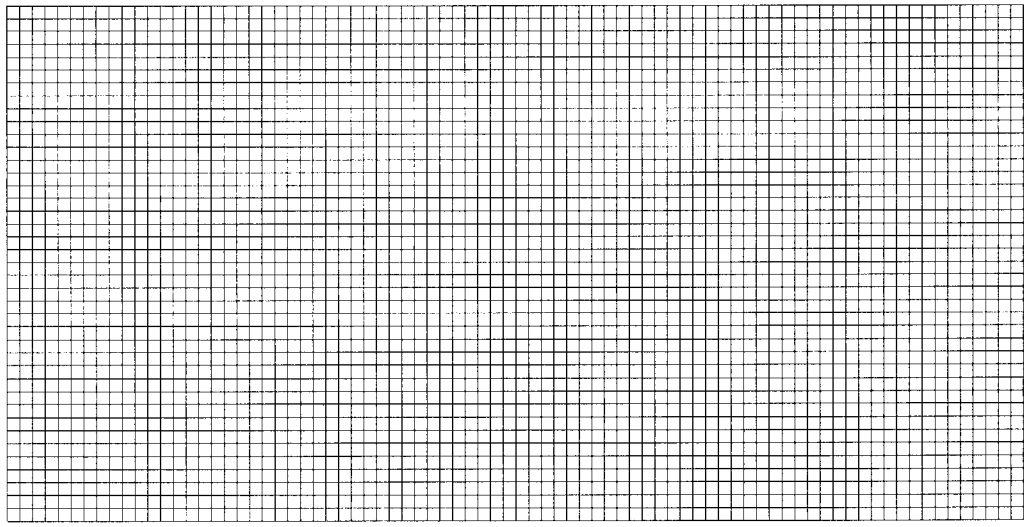
FIG. 53 illustrates a plan view of no mask.
Figure 54:
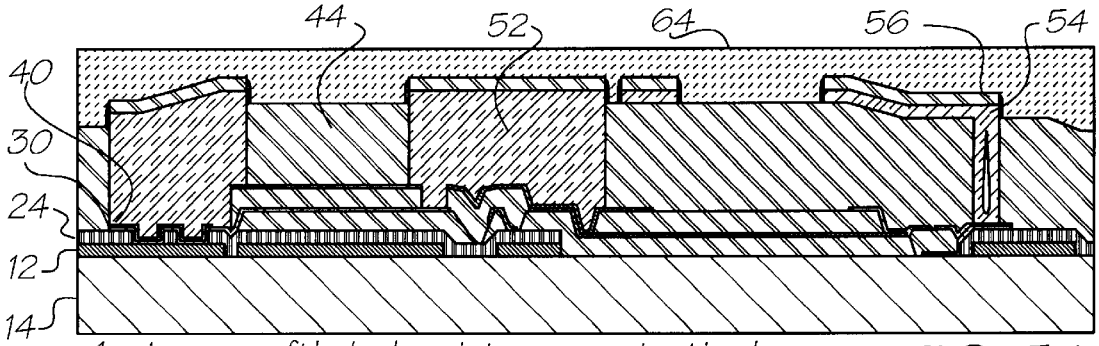
FIG. 54 illustrates a side sectional view of the softbake resist.

Spin on 4 microns of resist 64 and softbake (no mask—FIG. 53). This resist layer 64 is to protect the front side of the wafer during backetch. The resist thickness is to cover the topography of the MEMS devices, and thereby allow a vacuum chuck to be used. The resulting structure is as illustrated in FIGS. 52 and 54.

13) Back-etch Using Bosch Process

Figure 55:
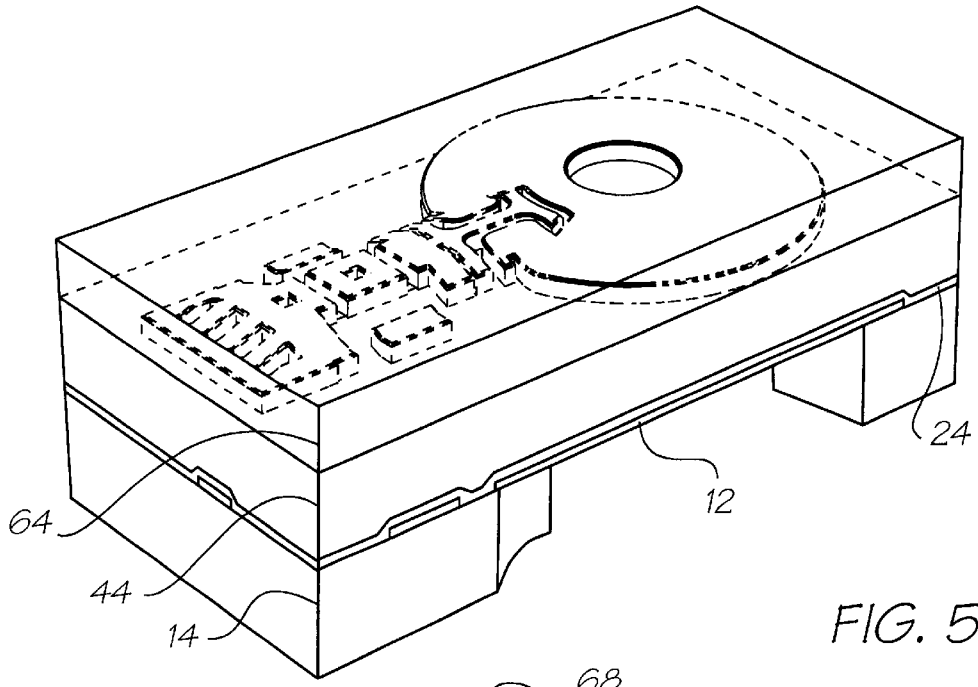
FIG. 55 illustrates a side perspective view of the back etch process.
Figure 56:
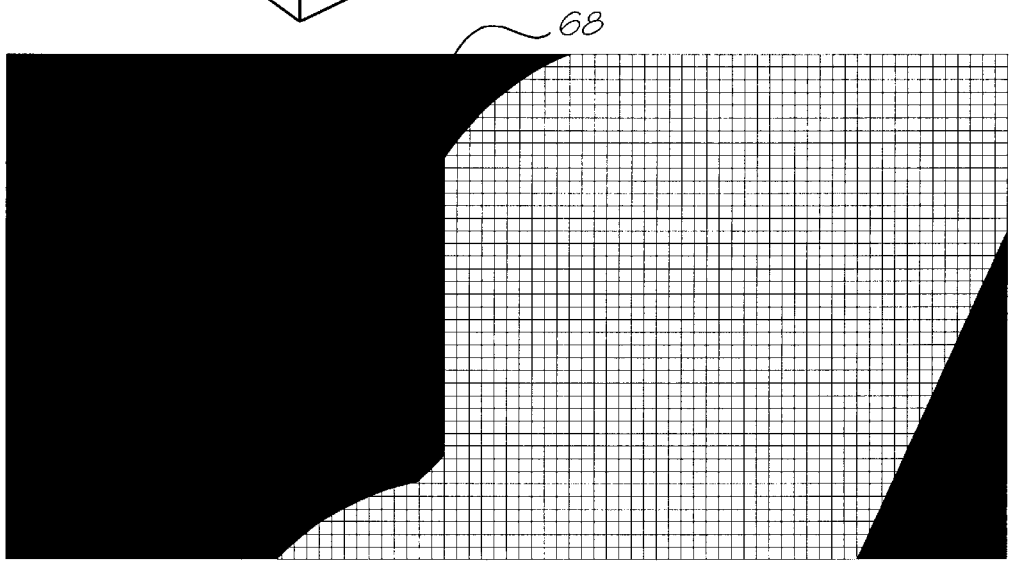
FIG. 56 illustrates a plan view of the back etch mask.
Figure 57:
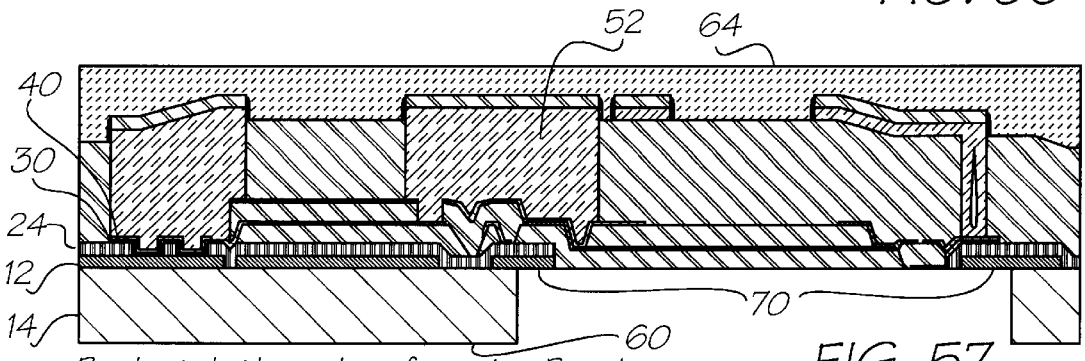
FIG. 57 illustrates a side sectional view of the back etch process.

The wafer/substrate 14 is thinned to 300 microns (to reduce back-etch time), and 3 microns of resist on the back-side 66 of the wafer 14 is exposed to Mask 68 (FIG. 56). Alignment is to metal portions 70 on the front side of the wafer 14. This alignment can be achieved using an IR microscope attachment to the wafer aligner. The wafer 14 is then placed on a platter and etched to a depth of 330 microns (allowing 10% overetch) using the deep silicon etch "Bosch process". This process is available on plasma etchers from Alcatel, Plasma-therm, and Surface Technology Systems. The resulting structure is as illustrated in FIGS. 55 and 57.

14) Strip all Sacrificial Material

Figure 58:
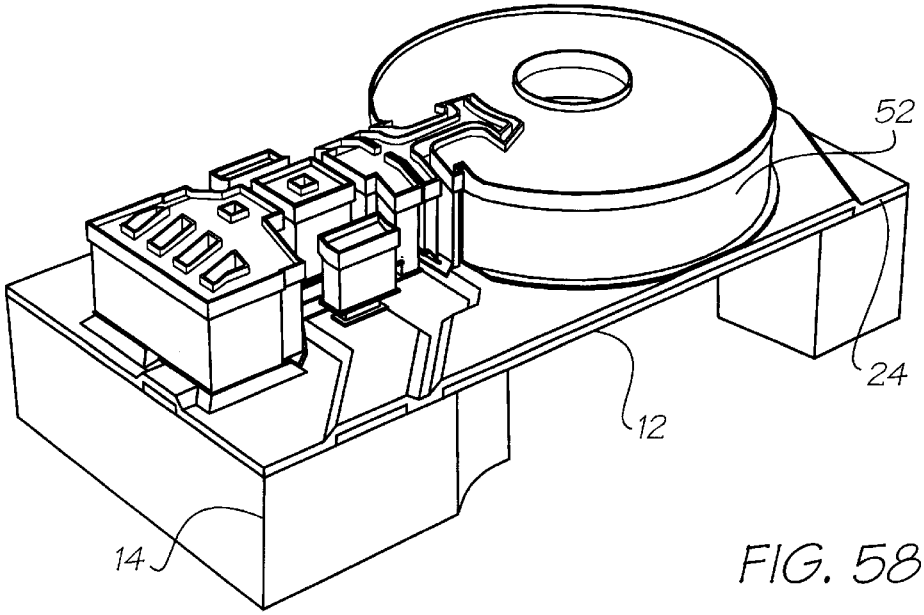
FIG. 58 illustrates a side perspective view of the organic material stripping.
Figure 59:
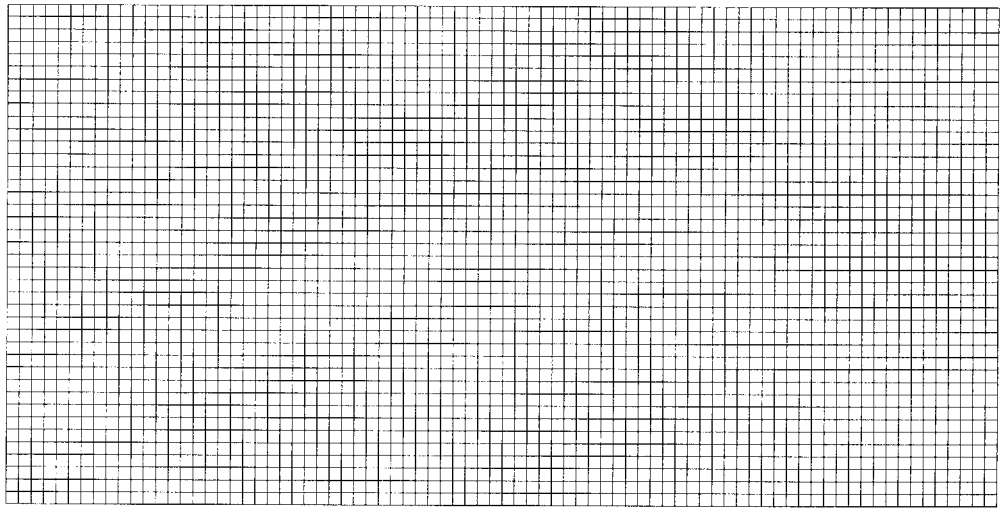
FIG. 59 illustrates a plan view of no mask.
Figure 60:
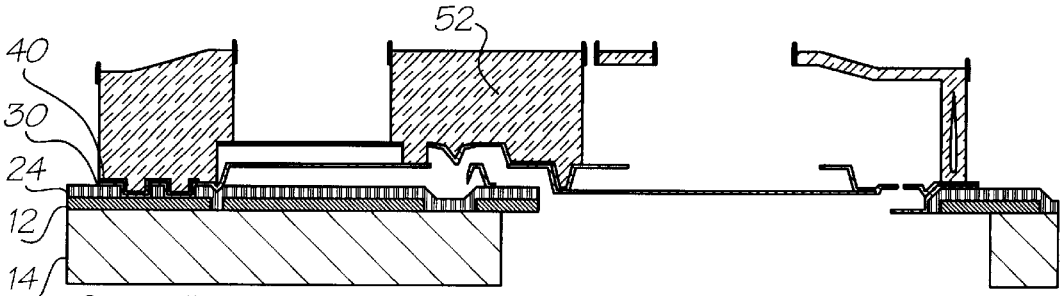
FIG. 60 illustrates a side sectional view of the organic material stripping.
Figure 61:
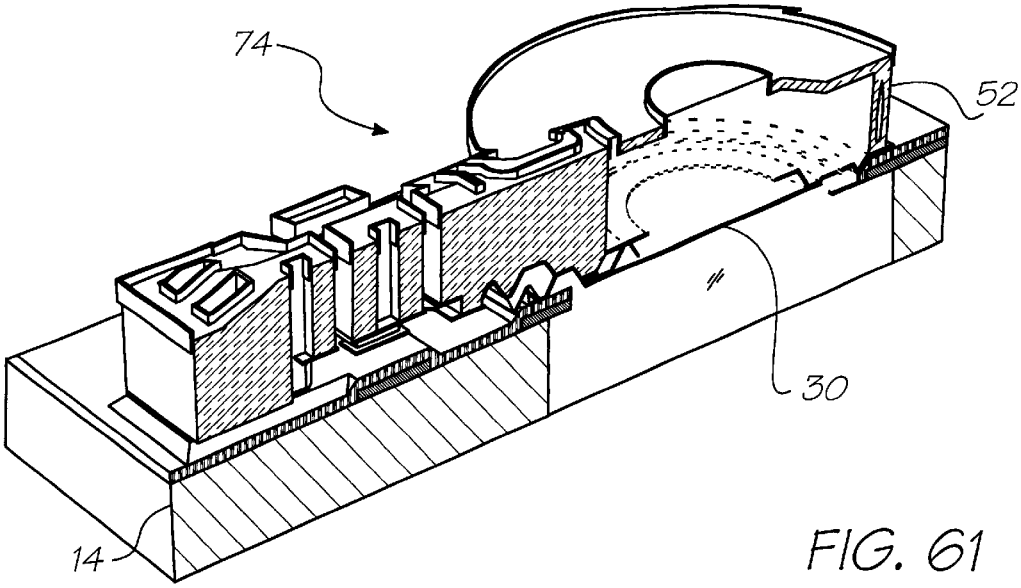
FIG. 61 illustrates a side perspective view partly in section of a single nozzle in a deactuated position.
Figure 62:
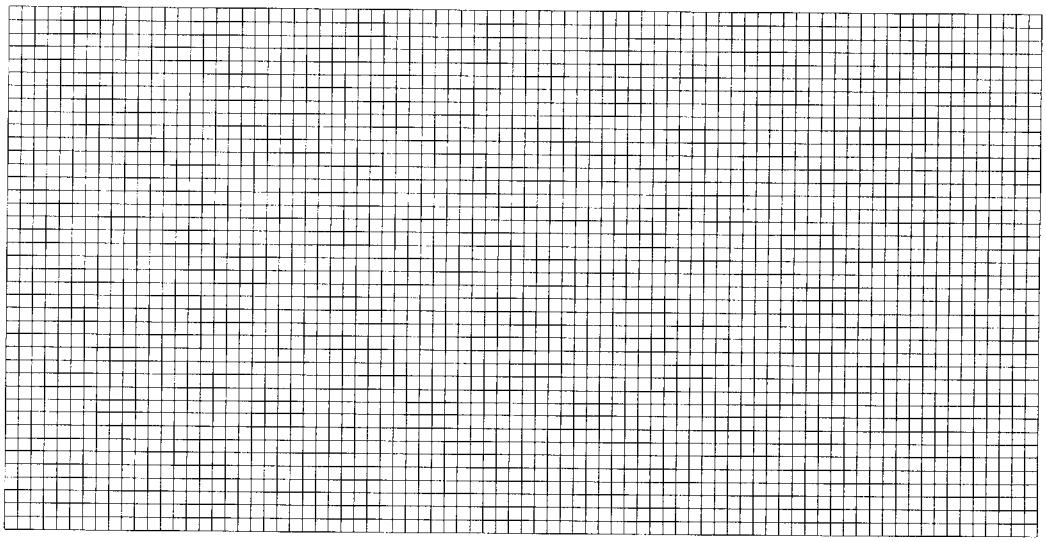
FIG. 62 illustrates a plan view of no mask.

The chips were diced by previous Bosch process backetch. However, the wafer 14 is still held together by 11 microns of polyimide. The wafers 14 must now be turned over. This can be done by placing a tray over the wafer on the platter, and turning the whole assembly (platter, wafer and tray) over while maintaining light pressure. The platter is then removed, and the wafer 14 (still in the tray) is placed in the oxygen plasma chamber. All of the sacrificial polyimide is etched in an oxygen plasma (no mask FIG. 59), resulting in the structure as illustrated in FIGS. 58 and 60.

15) Package, Bond, and Prime

Figure 63:
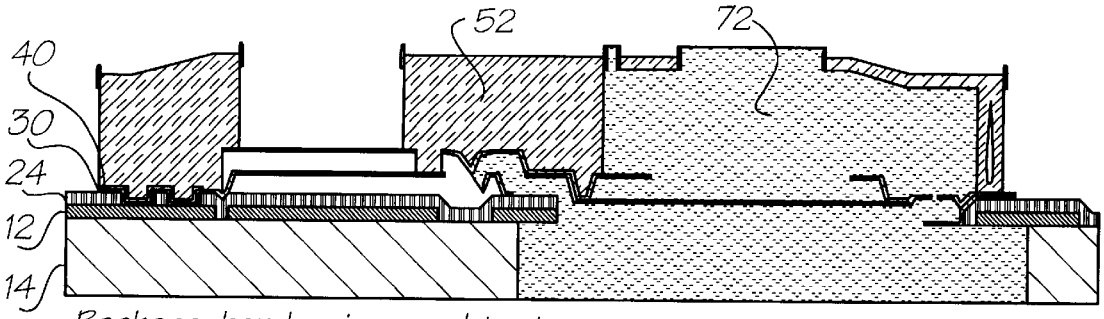
FIG. 63 illustrates a side sectional view of the package, bond prime and test.
Figure 64:
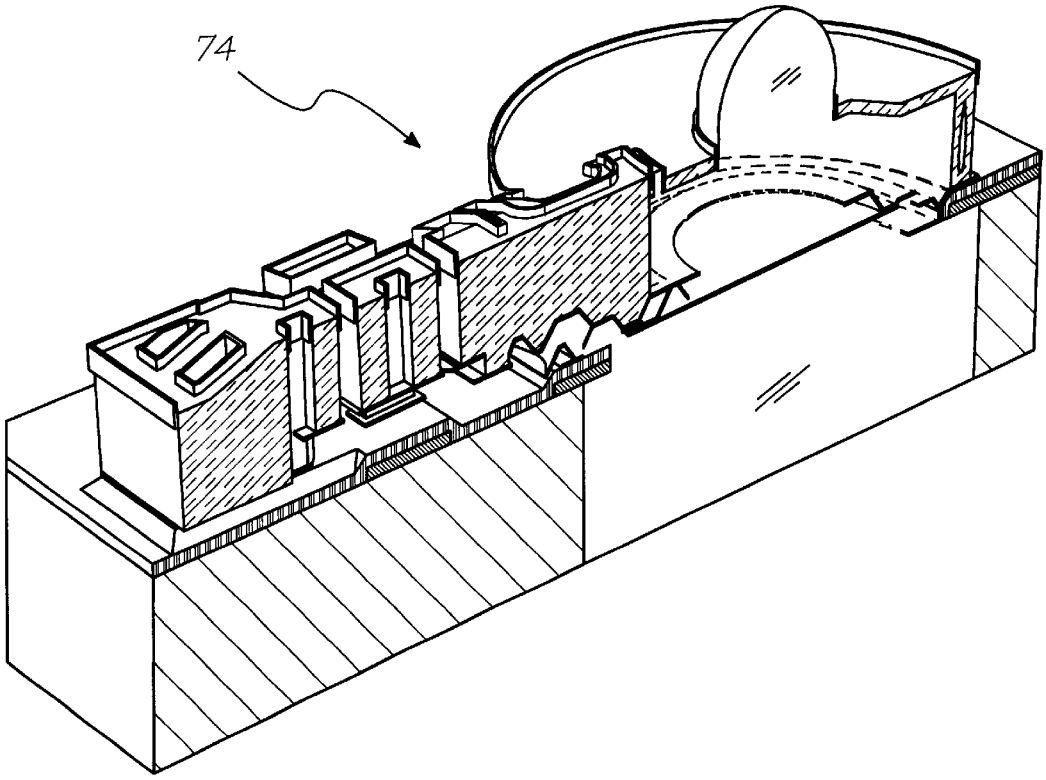
FIG. 64 illustrates a side perspective view partly in section of a single nozzle in an actuated position.
Figure 65:
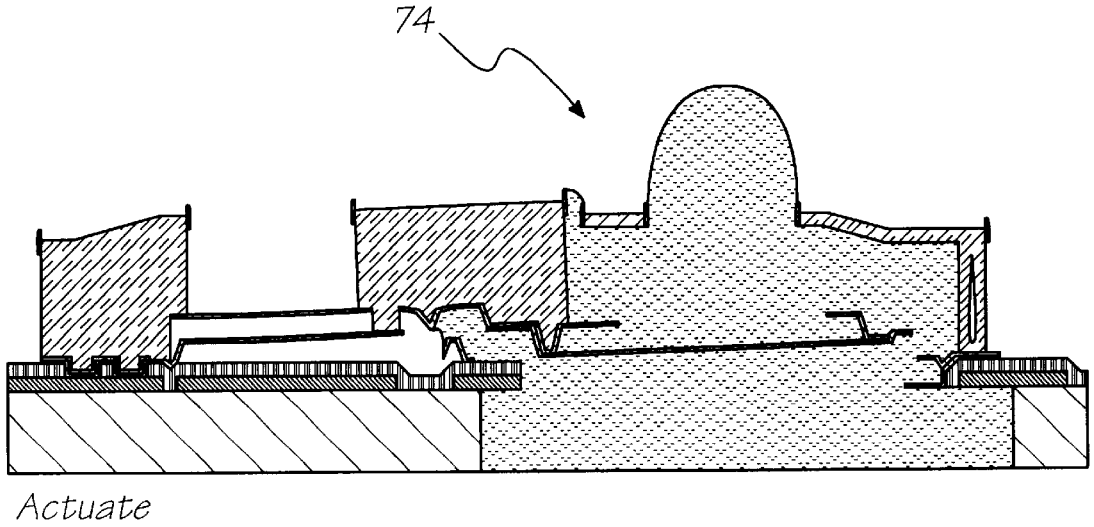
FIG. 65 illustrates a side section view of an actuating nozzle.
Figure 66:
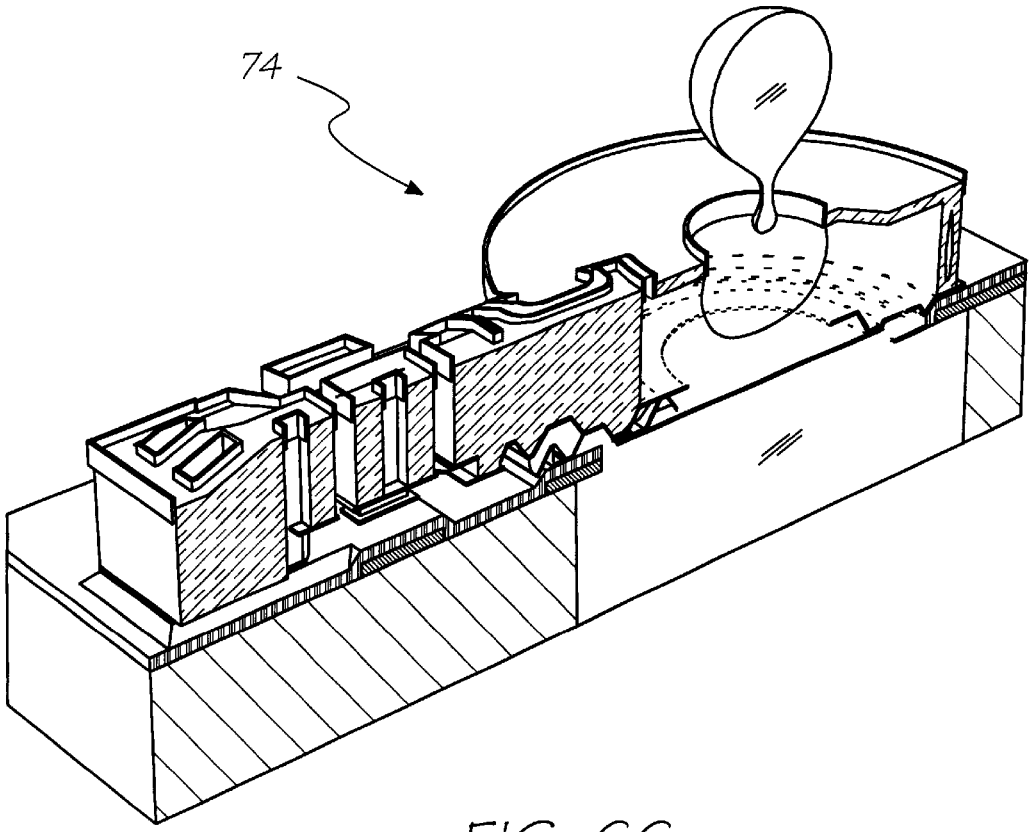
FIG. 66 illustrates a side perspective view in section of a nozzle ejecting ink.
Figure 67:
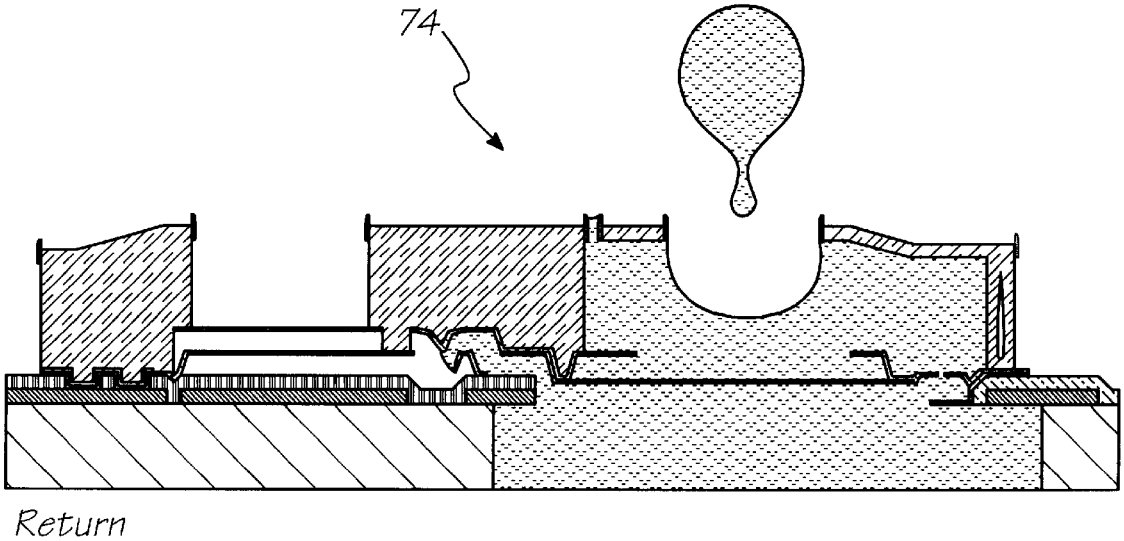
FIG. 67 illustrates a side sectional view of a deactuated nozzle.
Figure 68:
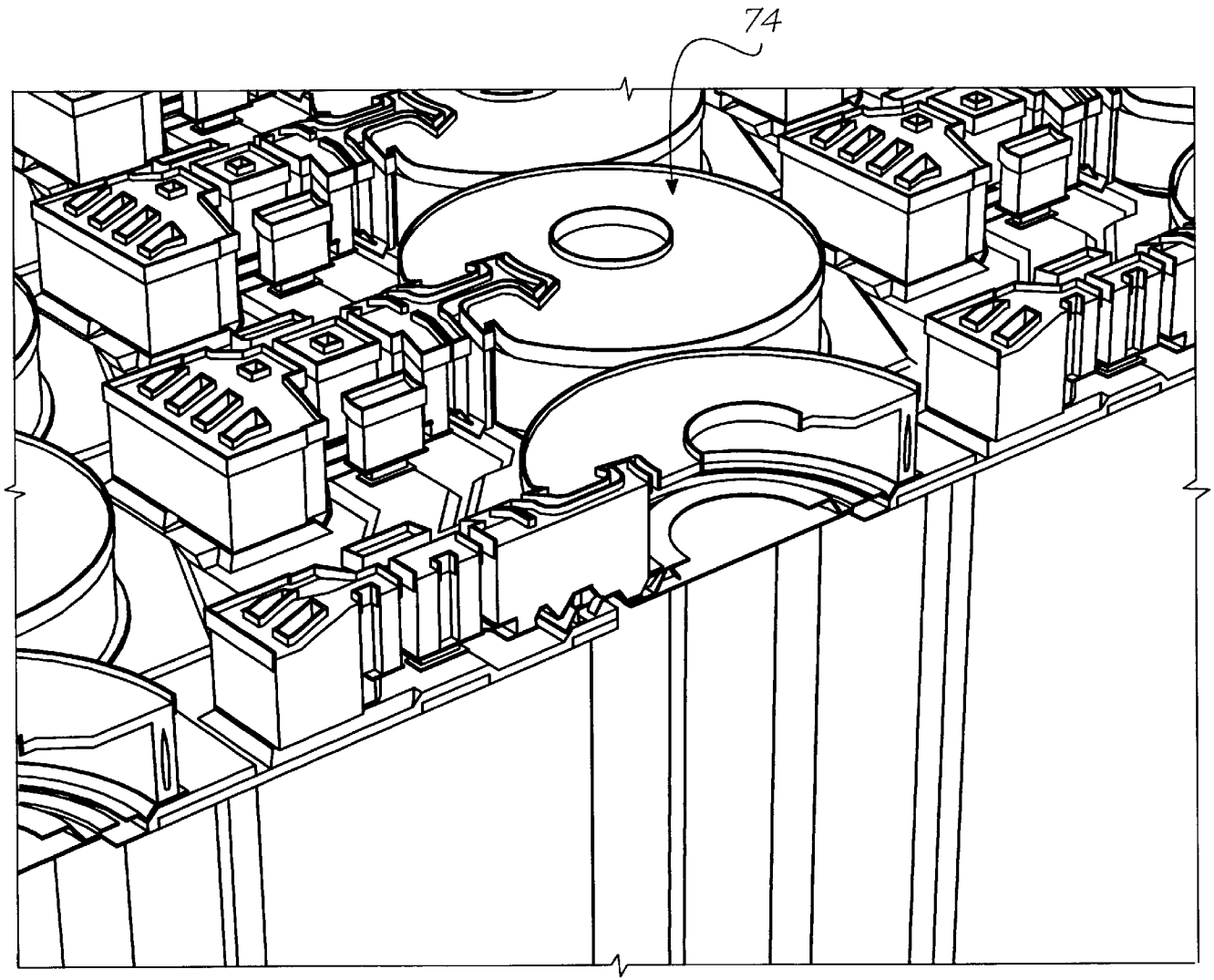
FIG. 68 illustrates a side perspective view of a portion of an array of nozzles.
Figure 69:
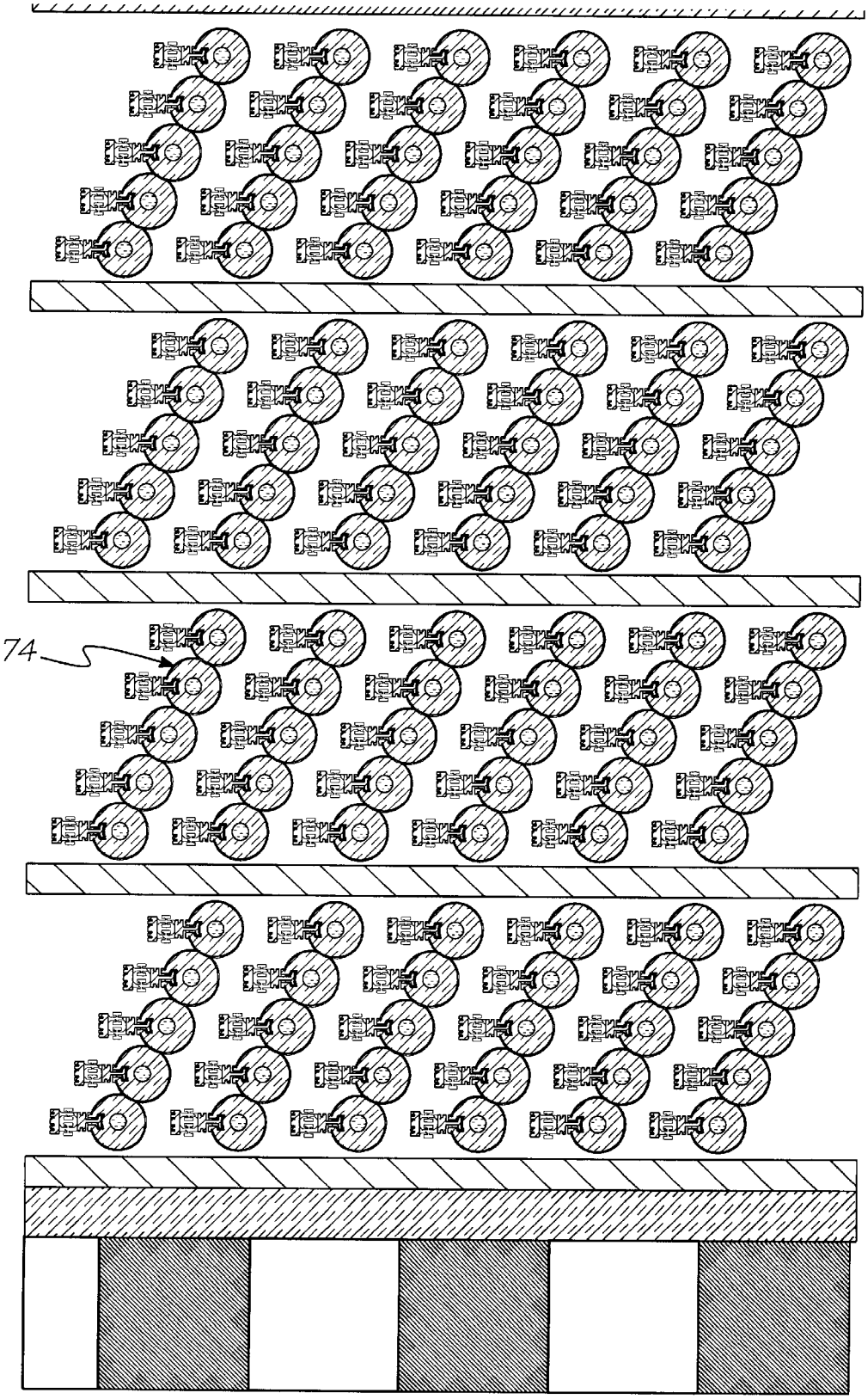
FIG. 69 illustrates a top plan view of a portion of an array of nozzles.
Figure 70:
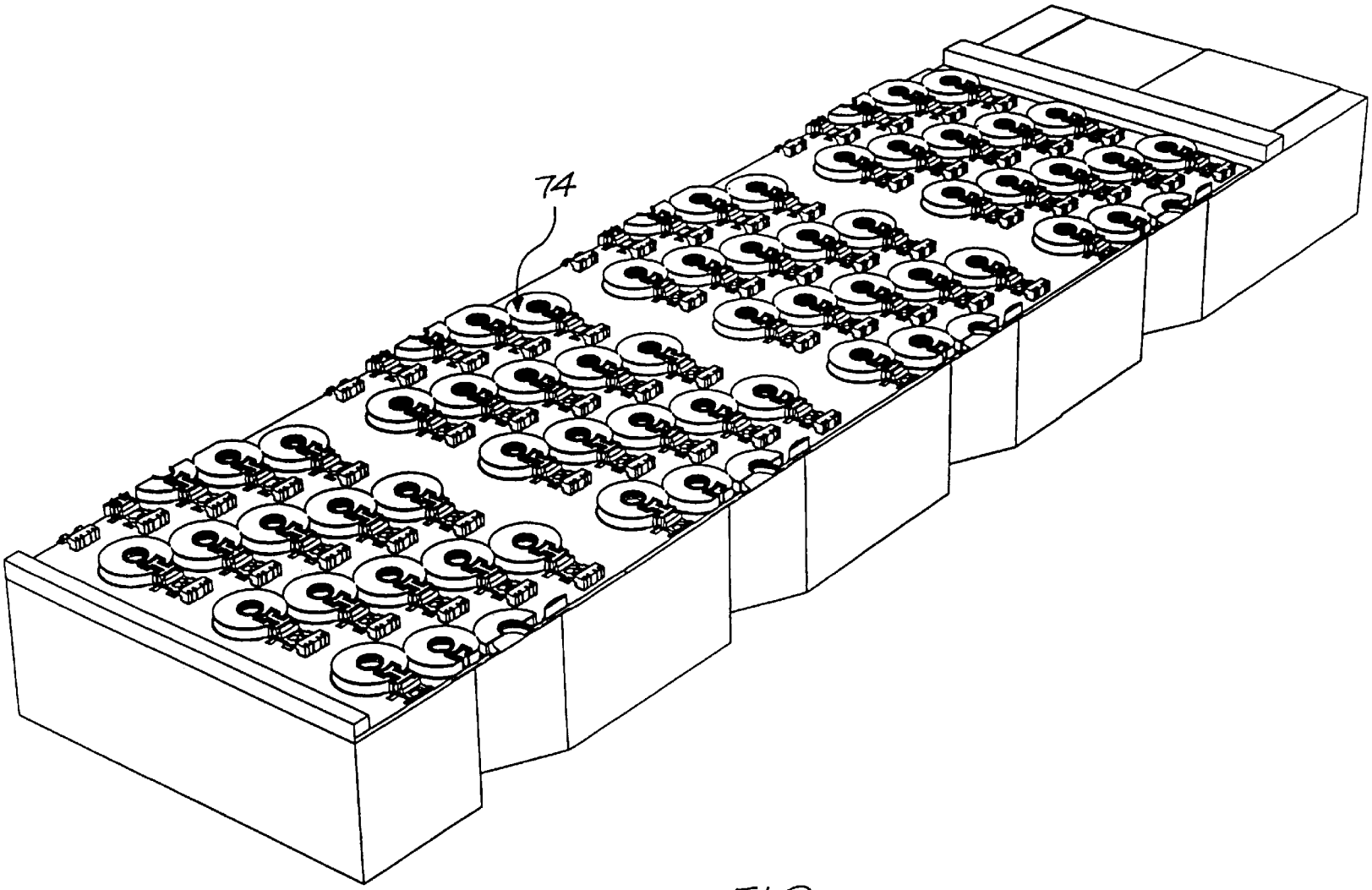
FIG. 70 illustrates a side perspective view of a portion of an array of nozzles.
Figure 71:
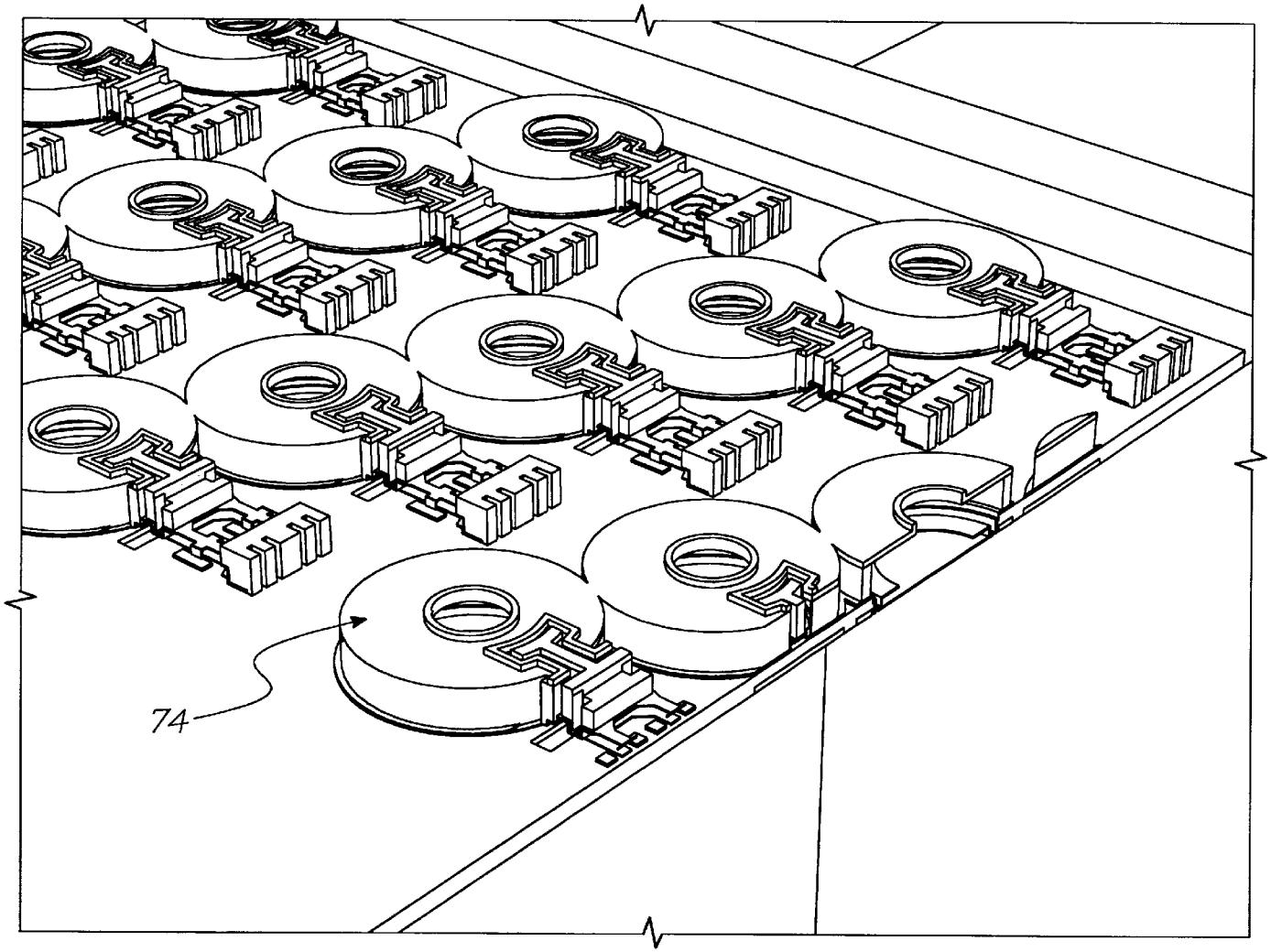
FIG. 71 illustrates a side perspective view of a portion of an array of nozzles.

Glue the chip into a package with an ink inlet hole, for example, a pressure transducer package. The ink hose should include a 0.5 micron absolute filter to prevent contamination of the nozzles. FIG. 63 shows the ink 72 in the nozzle 74.

FIGS. 64 to 67 illustrate the operation of the nozzle 74.

Figure 73:
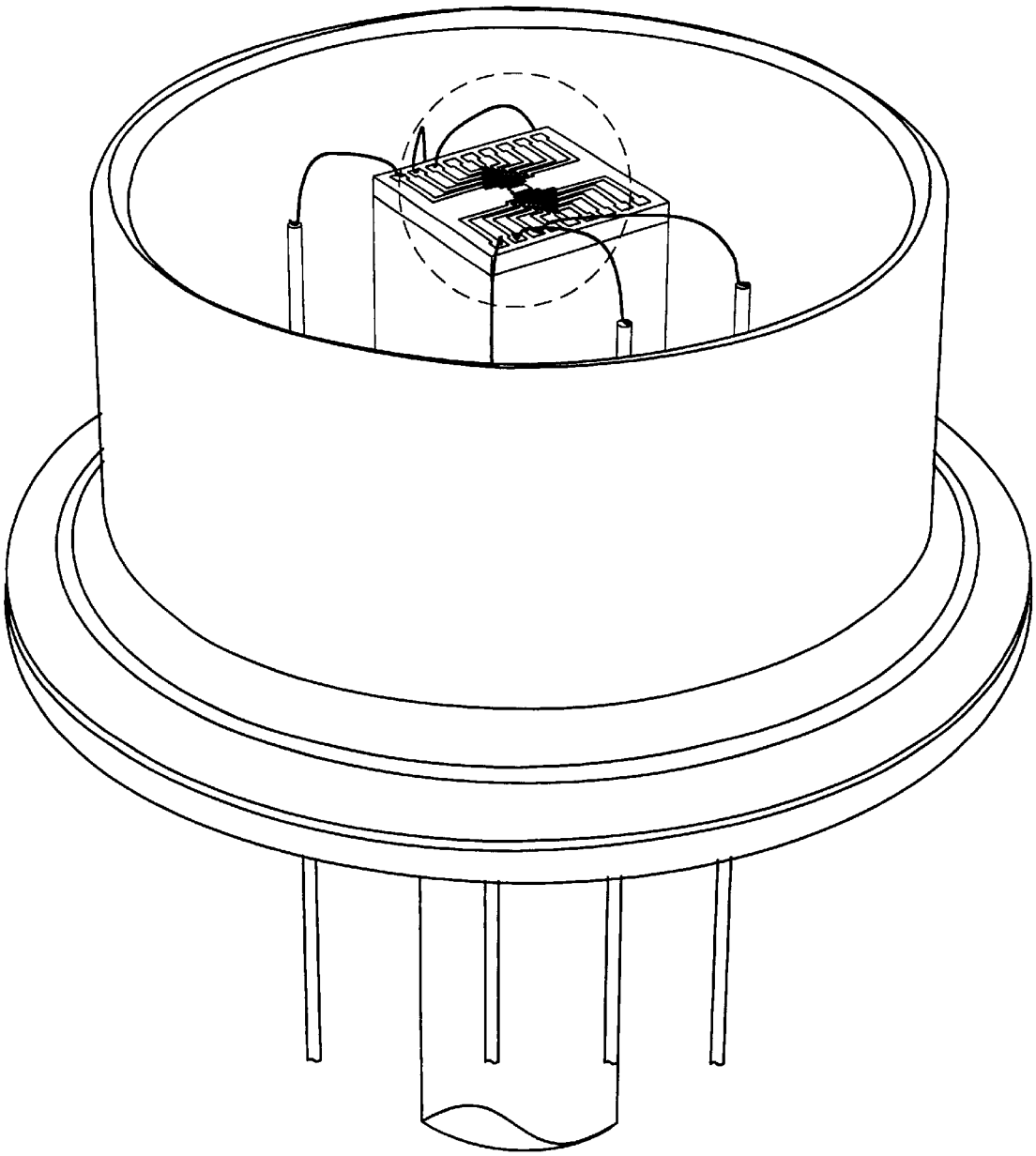
FIG. 73 illustrates a side perspective view of a mounted prototype chip.

The prototype Memjet chips are 3 mm square, but the ink inlet hole region is only about 240×160 microns, in the center of the chip. Glue the chip into the package so that the chip ink inlet is over the hole in the package. This requires only 500 micron accuracy. Wire bond the 6 connections to nozzles to be tested. Fill the packaged printhead under approx. 5 kPa ink pressure to prime it. The resulting package can be as illustrated in FIG. 72 and FIG. 73.

Obviously, large arrays of printheads can be simultaneously constructed as illustrated in FIG. 68 to FIG. 71 which illustrate various printhead array views.

The presently disclosed ink jet printing technology is potentially suited to a wide range of printing systems including: colour and monochrome office printers, short run digital printers, high speed digital printers, offset press supplemental printers, low cost scanning printers, high speed pagewidth printers, notebook computers with inbuilt pagewidth printers, portable color and monochrome printers, color and monochrome copiers, color and monochrome facsimile machines, combined printer, facsimile and copying machines, label printers, large format plotters, photograph copiers, printers for digital photographic 'minilabs', video printers, PhotoCD printers (PHOTOCD is a registered trademark of the Eastman Kodak Company), portable printers for PDAs, wallpaper printers, indoor sign printers, billboard printers, fabric printers, carnera printers and fault tolerant commercial printer arrays.

Further, the MEMS principles outlined have general applicability in the construction of MEMS devices.

It would be appreciated by a person skilled in the art that numerous variations and/or modifications may be made to the present invention as shown in the preferred embodiment without departing from the spirit or scope of the invention as broadly described. The preferred embodiment is, therefore, to be considered in all respects to be illustrative and not restrictive.

I claim:

1. A method of manufacture of a thermal bend actuator, the method comprising the steps of:

(a) depositing and etching, using a first mask, a first material on a substrate to form a first conductive layer;

(b) depositing and etching, using a second mask, a second material on the substrate to form a first sacrificial layer in a manner such that at least a portion of the first conductive layer remains uncovered;

(c) depositing and etching, using a third mask, a third material on the substrate to form a first conductive bend actuator layer in a manner such that the first bend actuator layer is in electrical contact with the uncovered portion of the first conductive layer for, in use, conductive heating of the first bend actuator layer;

(d) depositing and etching, using a fourth mask, a fourth material on the substrate to form a second sacrificial layer in a manner such that the second sacrificial layer covers substantially the entire first bend actuator layer;

(e) depositing and etching using a fifth mask, a fifth material on the substrate to form a second bend actuator layer; and (f) etching away the first and second sacrificial layers, thereby forming a first gap between the first and the second bend actuator layers and a second gap between the first actuator layer and the top surface of the underlying substrate.

2. A method as claimed in claim 1, wherein in step (c) the third material may be deposited and etched to form the first bend actuator layer and a first paddle layer of the bend actuator.

3. A method as claimed in claim 2, wherein in step (e) the fifth material may be deposited and etched to form the second bend actuator layer and a second paddle layer of the bend actuator.

4. A method as claimed in claim 1, wherein the method comprises, before step (b), the step of:

(g) depositing and etching, using a sixth mask, a sixth material on the substrate to form a protective layer on top of the substrate in a manner such that at least the portion of the first conductive layer remains uncovered.

5. A method as claimed in claim 1, wherein the method further comprises, before step (f), the steps of (h) depositing and etching, using a seventh mask, a seventh material on the substrate to form a third sacrificial layer in a manner such that the third sacrificial layer covers substantially the entire second bend actuator layer;

(i) forming a first conformal layer of an eighth material covering the third sacrificial layer on the substrate; and wherein step (f) further comprises etching away the third sacrificial layer to form a nozzle chamber around and above the bend actuator.

6. A method as claimed in claim 1, wherein the method comprises, before step (f), the step of (j) back etching the substrate from a back surface of the substrate to the first conductive layer for facilitating step (f).

7. A method as claimed in claim 5, wherein the method comprises, before step (i), the step of:

(k) depositing and etching a ninth material on the substrate to form a ninth mask in the ninth material on top of the third sacrificial layer;

(l) etching, using the tenth mask, portions of the third sacrificial layer; and wherein step (i) further comprises depositing the eighth material in a manner such as to fill the etched portions of the third sacrificial layer to form a side wall structure of the nozzle chamber.

8. A method as claimed in claim 7, wherein the method further comprises, before step (f) the step of:

(m) etching the first conformal layer to form a nozzle of the nozzle chamber,

Step (m) may comprise depositing and etching a tenth material to form a tenth mask on top of the first conformal layer, and etching the first conformal layer through the tenth mask to from the nozzle; and wherein step (f) further comprises etching away the tenth material.

9. A method as claimed in claim 8, wherein the method further comprises, before step (f), the step of:

(n) forming a vertical nozzle wall of the nozzle by depositing and etching an eleventh material, wherein the etch comprises an overetch.

10. A method as claimed in claim 1, wherein the first conductive bend actuator layer and the second bend actuator layer comprise substantially the same material.

11. A method as claimed in claim 10, wherein the same material is titanium nitride.

12. A thermal bend actuator manufactured by a method comprising the steps of:

(a) depositing and etching, using a first mask, a first material on a substrate to form a first conductive layer;

(b) depositing and etching, using a second mask, a second material on the substrate to form a first sacrificial layer in a manner such that at least a portion of the first conductive layer remains uncovered;

(c) depositing and etching, using a third mask, a third material on the substrate to form a first conductive bend actuator layer in a manner such that the first bend actuator layer is in electrical contact with the uncovered portion of the first conductive layer for, in use, conductive heating of the first bend actuator layer;

(d) depositing and etching, using a fourth mask, a fourth material on the substrate to form a second sacrificial layer in a manner such that the second sacrificial layer covers substantially the entire first bend actuator layer;

(e) depositing and etching using a fifth mask, a fifth material on the substrate to form a second bend actuator layer; and (f) etching away the first and second sacrificial layers, thereby forming a first gap between the first and the second bend actuator layers and a second gap between the first actuator layer and the top surface of the underlying substrate.

* * * * *